US007038365B2

(12) United States Patent
Kang

(10) Patent No.: US 7,038,365 B2
(45) Date of Patent: May 2, 2006

(54) ELECTRODE-LESS FLUORESCENT LAMP HAVING A 3-DIMENSIONAL STRUCTURE, AND A METHOD FOR MANUFACTURING THE SAME

(76) Inventor: Seong-Jin Kang, 1011, Saksun-ri, Taean-eup, Taean-gun, 357-907, Chungcheongnam-do (KR)

( * ) Notice: Subject to any disclaimer, the term of this patent is extended or adjusted under 35 U.S.C. 154(b) by 8 days.

(21) Appl. No.: 10/475,230

(22) PCT Filed: Apr. 17, 2002

(86) PCT No.: PCT/KR02/00702

§ 371 (c)(1),
(2), (4) Date: Mar. 11, 2004

(87) PCT Pub. No.: WO02/084704

PCT Pub. Date: Oct. 24, 2002

(65) Prior Publication Data

US 2004/0145291 A1 Jul. 29, 2004

(30) Foreign Application Priority Data

Apr. 17, 2001 (KR) ..... 2001-20548

(51) Int. Cl.
*H01J 1/88* (2006.01)
*H05B 41/16* (2006.01)

(52) U.S. Cl. ..... 313/264; 313/261; 313/161; 313/18; 315/248; 315/267

(58) Field of Classification Search ..... 313/18, 313/17, 160, 161, 153; 315/248, 267, 344, 315/348

See application file for complete search history.

(56) References Cited

U.S. PATENT DOCUMENTS

| | | | | |
|---|---|---|---|---|
| 4,180,763 A | | 12/1979 | Anderson | 315/248 |
| 5,808,414 A | * | 9/1998 | Wharmby et al. | 313/607 |
| 5,834,905 A | * | 11/1998 | Godyak et al. | 315/248 |
| 5,932,961 A | * | 8/1999 | Wentzel et al. | 313/493 |
| 6,246,183 B1 | * | 6/2001 | Buonavita | 315/248 |
| 6,404,122 B1 | * | 6/2002 | Lankhorst et al. | 313/490 |

FOREIGN PATENT DOCUMENTS

| | | | |
|---|---|---|---|
| EP | 0 203 194 A1 | | 12/1986 |
| EP | 0 808 807 A1 | | 11/1997 |
| EP | 0 910 112 A2 | | 4/1999 |
| JP | 05-190005 | * | 7/1993 |
| WO | WO 97/10610 A1 | | 3/1997 |

* cited by examiner

*Primary Examiner*—Tuyet Thi Vo
(74) *Attorney, Agent, or Firm*—Knobbe, Martens, Olson & Bear LLP

(57) ABSTRACT

An electrode-less fluorescent lamp and a method for manufacturing the same are disclosed. The electrode-less fluorescent lamp includes a closed-loop tubular discharge tube enclosing a discharge gas. The tube is coated with a fluorescent layer on an inner surface and is made of a light-transmissive material. The lamp also includes at least one core surrounding at least a portion of the discharge tube. The lamp includes at least one coil wound around the at least one core. The coil supplies electromagnetic power to the discharge tube by producing a time-varying magnetic field in the core. In addition, the lamp includes a radio frequency (RF) power source supplying RF power to the coil so that discharge generated in the discharge tube is maintained by said RF power.

12 Claims, 25 Drawing Sheets

PRIOR ART

ELECTRODE-LESS FLUORESCENT LAMP HAVING A 3-DIMENSIONAL STRUCTURE, AND A METHOD FOR MANUFACTURING THE SAME

This application is the national phase under 35 U.S.C. 5 371 of PCT International Application No. PCT/KR02/00702 which has an International filing date of Apr. 17, 2002, which designated the United States of America and which claims priority on Republic of Korea Patent Application number 2001/20548 filed Apr. 17, 2001, the entire contents of which are hereby incorporated herein by reference.

TECHNICAL FILED

The present invention is related to an electrode-less fluorescent lamp having a 3-dimensional ("3-D") structure and a method for manufacturing the same. In particular, the present invention is related to an electrode-less fluorescent lamp that has a tubular structure which may be manufactured easily and configured in a 3-dimensional solid structure to make installation space reduced and to improve the intensity of illumination, and to a method for manufacturing the same.

BACKGROUND ART

A fluorescent lamp is one of lamps popularly used in all kinds of lighting systems. In general, a fluorescent lamp includes a light-tranmissive discharge tube, such as glass, quartz, or etc., coated with a fluorescent layer, electrodes for discharging in the discharge tube, and a discharge gas, such as mercury vapor, a buffer gas and etc; sealed in the discharge tube. When electric power is applied to the electrodes, the sealed discharge gas generates discharge and plasma is generated in the discharge tube. Then, electrons in the plasma excite fluorescent materials on the inner surface of the discharge tube to make them emit the visible-light.

As described in the above, because the conventional fluorescent lamp produces plasma in response to discharge produced by the electrodes, the electrodes are deteriorated by the sputtering effect of ions in the plasma. This is known as one of the causes of shortening length of life and limiting input power of a fluorescent lamp.

A conventional electrode-less fluorescent lamp suggested in order to overcome these defects and achieve a fluorescent lamp of long life and high output, is shown in FIG. 1. Generally, an electrode-less fluorescent lamp includes a closed-loop type discharge tube as shown in FIG. 1, cores disposing around on a predetermined region of the closed-loop type discharge tube, and coils wound around the cores.

If predetermined frequency power is supplied to the coil, time-varying magnetic field is induced, therefore plasma inside the discharge tube is produced by induced electromotive force in response to this time-varying magnetic field, and the plasma keeps going unless power is cut off.

Induced electromotive force induced inside the discharge tube is governed by Faraday's law as known well, and the induced electromotive force can be expressed by the following equation.

$$\nabla \times E = -\delta B/\delta t \qquad \text{[Math. Equation 1]}$$

This induced electromotive force gives accelerating energy to electrons in the plasma, and the electrons transfer the accelerating energy to particles of other neutral gases by means of collision. According to this, excitation and ionization occur continuously inside the plasma, and it is possible that electric charges are provided continuously by recombination and compensation of surface loss.

In that the visible-light is produced by excitation of a fluorescent layer which is originated from electrons inside plasma produced by inductive coupling, there is no difference from the principle of the conventional fluorescent lamps. Therefore the detailed description is omitted.

As described in the above, in the conventional inductively coupled electrode-less fluorescent lamp, a core disposed around the discharge tube plays not only the same role as a transformer core or a ferrite core, but a role preventing loss of the magnetic field from outside, enhancing power transforming efficiency by keeping the magnetic field inside the core, and enabling to start and maintain the discharge.

Like this, an inductively coupled electrode-less fluorescent lamp does not need electrodes inside the discharge tube. Therefore a fluorescent lamp having a relatively long life can be provided. Because high power can be supplied without worrying about wearing in response to sputtering of electrode materials, a high output fluorescent lamp can be provided. And light-flux decline decreases remarkably because sputtering of a volatile material, such as an electron-radiating material coated on electrode materials or electrodes, does not occur and compound of a volatile material and mercury are not produced.

Until now, various types of electrode-less fluorescent lamps are disclosed. Anderson discloses a closed-loop type tubular electrode-less fluorescent lamp having a discharge current between 0.25 and 1.0 ampere, and a buffer gas pressure between 0.5 and 5 Torr (U.S. Pat. No. 3,500,118). Then, Godyak and etc disclose a closed-loop type tubular electrode-less fluorescent lamp having a mercury vapor and a buffer gas pressure less than about 0.5 Torr unlike Anderson (U.S. Pat. No. 3,500,118). In addition, it is one of the primary features that in operation, the lamp described by Godyak and etc has a discharge current equal to or greater than about 2 amperes in order to achieve higher efficiency than that of Anderson.

As shown in FIG. 2, in order to improve a structure of a simple Anderson-type discharge tube with an excessively heavy core, Godyak and etc fabricate not a discharge tube having a simple closed-loop structure but a discharge tube having a structure necked down on a portion of it, and reduce weight of a lamp assembly in the way that diameter and weight of the core are reduced by disposing it on the portion necked down. In addition, they represent a somewhat complex method for manufacturing the discharge tube.

However, because the electrode-less fluorescent lamp as disclosed in the above has a simple plane structure, light distribution is not uniform. Thus, the lamp is not appropriate to be substituted for an incandescent lamp or a high output lamp used for down lighting used in buildings in an aspect of size and structure. That is, an incandescent lamp or a high output lamp are used for the lighting system, which has a structure put into the ceiling or walls, in most of buildings, and used for local lighting and directional down lighting. The electrode-less fluorescent lamp described in the above has a problem to apply to existing lighting systems because the discharge tube has a plane closed-loop structure.

Further, there are several lamp structures represented to substitute an electrode-less fluorescent lamp for an existing incandescent electric lamp or an existing high output lamp (for example, U.S. Pat. No. 5,767,617, U.S. Pat. No. 5,959, 405, and etc), but these approaches are very difficult in manufacturing, thus cause the lamp unit cost to rise.

DISCLOSURE OF INVENTION

DETAILED DESCRIPTION

The present invention is suggested in order to fix the aforementioned problems, and has a purpose providing an electrode-less fluorescent lamp that has a tubular structure which can be manufactured easily, and is configured by a 3-dimensional solid structure, and providing a method for manufacturing the same.

In addition, the present invention has another purpose providing an electrode-less fluorescent lamp having a 3-dimensional solid structure applicable to a socket for a conventional incandescent lamp and/or a conventional lighting system, and providing a method for manufacturing the same.

Power generated by the RF source is supplied to a coil. Time-varying magnetic field is induced inside the core in response to the RF power supplied. Finally, power is supplied to inside a tubular discharge tube having a closed-loop structure in response to the magnetic field induced.

As shown in FIG. 15, the discharge tube of the present invention can be described in detail by defining a virtual closed-curve formed by a center-line through the discharge tube and a virtual closed-curved-surface formed by the closed-curve. In the present description, "the center-line through the discharge tube" is defined as "a line connecting center-points of all cross-sections of a discharge tube along with a longitudinal direction of the discharge tube," "the virtual closed-curve" is defined as "a closed-curve formed by the center-line through the discharge tube," "the virtual closed-curved-surface" is defined as "a closed-curved-surface formed by the virtual closed-curve in the 3-D space."

FIG. 15*a* is showing a closed-curved-surface 152 formed by a discharge tube of a conventional electrode-less fluorescent lamp, and the closed-curved-surface has a 2-dimensional ("2-D") oval or circle shape capable to be included on a plane. By the way, FIG. 15*b* is showing a virtual closed-curve 153 which can be defined in a discharge tube in accordance with an embodiment of the present invention, a virtual closed-curved-surface 154 formed by the virtual closed curve, and also that the virtual closed-curved-surface forms a U-shaped closed curved surface 154 bent.

In short, while a virtual closed-curved-surface 152 formed by a virtual closed-curve 151 in accordance with a conventional electrode-less fluorescent lamp has a plane (2-D) structure, the closed-curved-surface of the present invention has a 3-D structure.

BEST MODE FOR CARRYING OUT THE INVENTION

Now, preferred embodiments will be described with reference to the attached drawings.

Figure 1A:
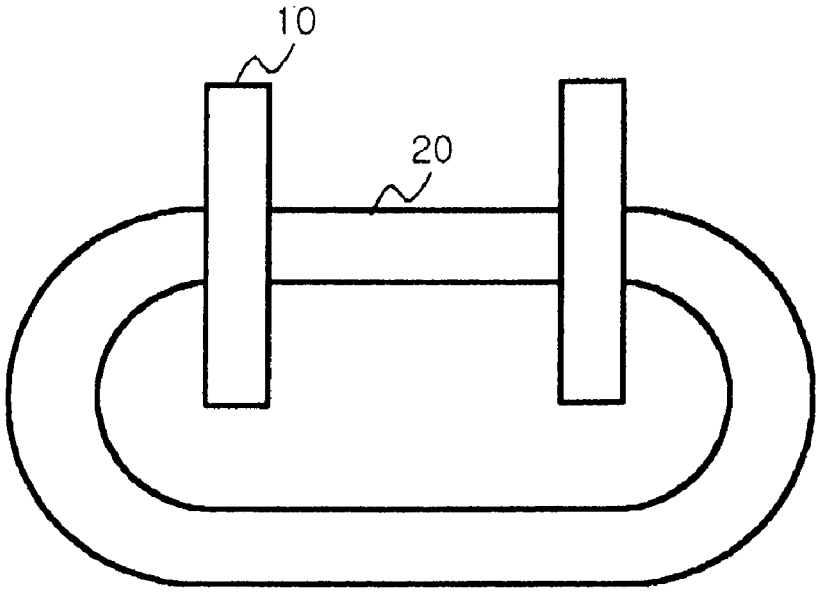
FIGS. 1*b* and 1*b* are schematic diagrams showing a conventional inductive type electrode-less fluorescent lamp.
Figure 1B:
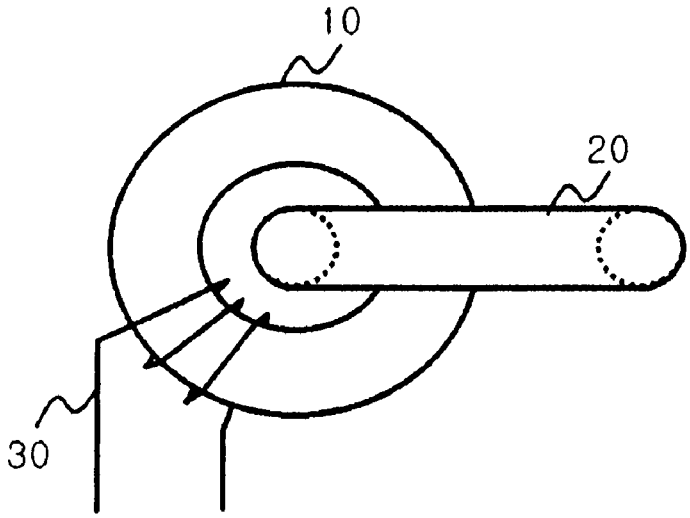
PRIOR ART Fig. 1b
Figure 2:
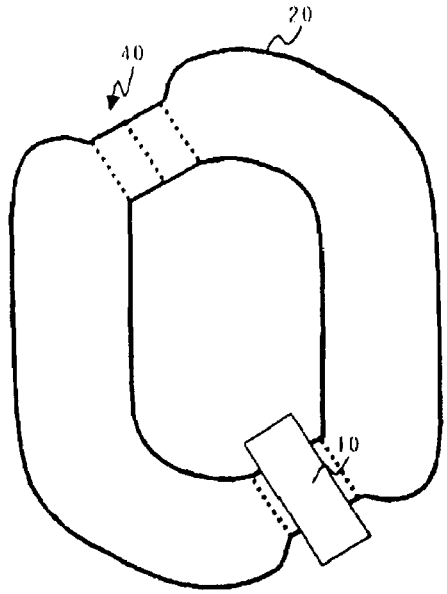
FIG. 2 is a schematic diagram showing another conventional inductive type electrode-less fluorescent lamp.
Figure 3:
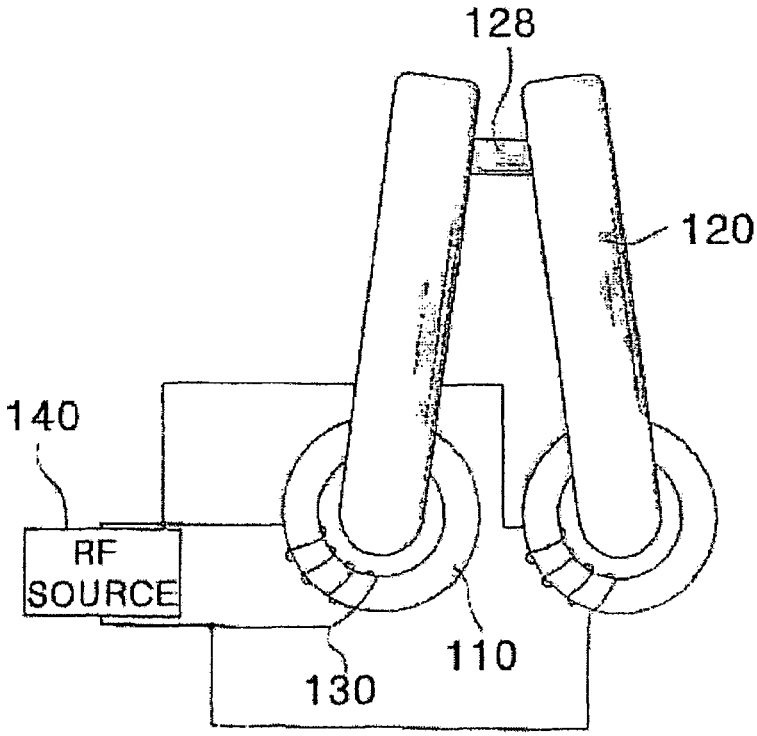
PRIOR ART Fig. 3
FIG. 3 is a schematic diagram showing an electrode-less fluorescent lamp in accordance with a first embodiment of the present invention.

FIG. 3 is disclosing a schematic diagram of the electrode-less fluorescent configuration in accordance with an embodiment of the present invention.

In accordance with an embodiment of the present invention, an electrode-less fluorescent lamp includes a light-transmissive discharge tube 120 having a closed tubular structure enclosing a buffer gas wherein the virtual closed-curved-surface formed by the virtual closed-curve has a 3-D structure in the space, having a fluorescent layer on the inner surface; one or more cores 110 fabricated of a more permeable material than air, disposed so as to surround a portion of the discharge tube; one or more coils wound around the core in order to supply power to the discharge tube by inducting magnetic field inside the core; a radio frequency power source ("RF source") for maintaining the discharge inside the discharge tube by supplying RF power to the coil.

Power generated in the RF source is supplied to the coil, thus induces time-varying magnetic field. In response to the induced magnetic field, the power is supplied to inside the closed-loop structure tubular discharge tube.

As shown in FIG. 3, the discharge tube, the core, and the coil are joined together, and thus form an electrode-less fluorescent lamp of the present invention. In accordance with practical embodiments of the present invention, the RF source may be coupled to the discharge tube, the core and the coil, or it may be configured separately from them. In case substituting the electrode-less fluorescent lamp of the present invention for the conventional incandescent lamp or the conventional high output lamp, it is desirable that RF source is coupled to rest of the components. Preferably, RF source is coupled to the connecting part positioned between the lower end of the electrode-less fluorescent lamp and the socket.

In general, pressure inside the discharge tube gradually increases during the discharge in response to evaporation of the fluorescent material and the out-gassing of contents in the fluorescent layer due to electric charges of the discharge. A feature of the discharge is sensitive to pressure change, eventually increase of pressure inside the discharge is a factor capable to determine a life of the lamp. Therefore, vacuum degree should be maintained for more than predetermined time, which can prevent reduction of the lamp life and maintain stability in the operation of the lamp. Herein, the vacuum degree is defined as degree of vacuum, and is expressed by pressure of the remaining gas. Pa, mmHg, Torr, and etc are used as units.

In the present invention, it is one of the primary features that the electrode-less fluorescent lamp having a 3-D structure includes a mercury vapor and a buffer gas at pressure equal to or greater than 0.5 Torr in order to achieve maximum output and maximum life, and thus the lamp operates in the relatively high pressure range. In the high pressure range, the lamp operates stably due to an advantageous characteristics that the discharge is relatively less sensitive to pressure increase.

FIG. 4 is a schematic diagram showing a configuration of an electrode-less fluorescent lamp in accordance with another embodiment of the present invention.

Figure 4A:
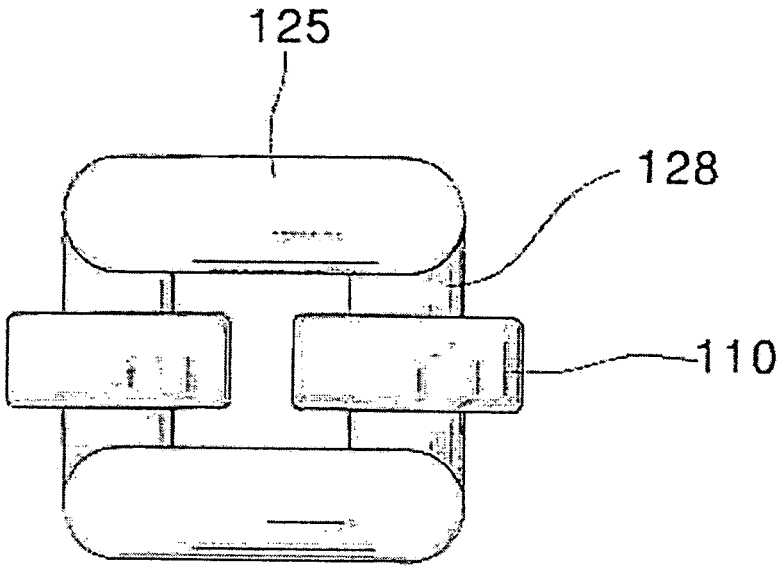
FIGS. 4*a*–4*c* are schematic diagrams showing an electrode-less fluorescent lamp in accordance with a second embodiment of the present invention.
Figure 4B:
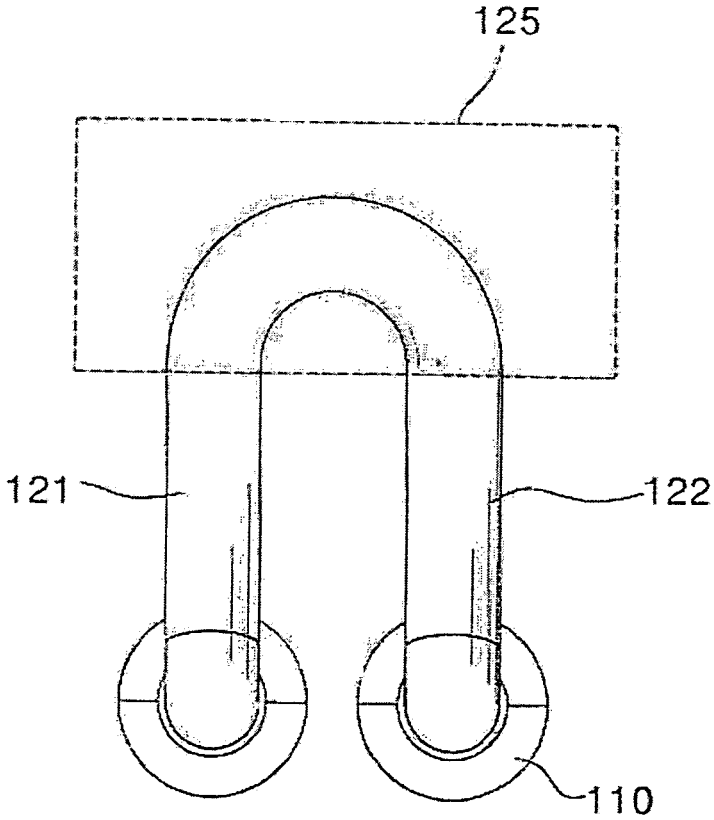
Figure 4C:
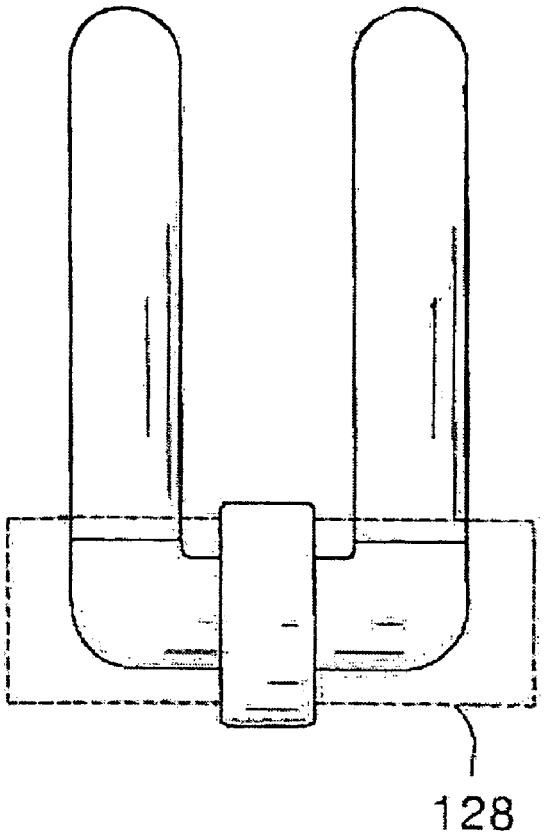

In accordance with the present embodiment, FIG. 4 is showing a plane view (see FIG. 4*a*), a front view (see FIG. 4*b*), and a side view (see FIG. 4*c*) of the configuration including a discharge tube 120 and a core 110 of an electrode-less fluorescent lamp which are coupled to each other.

The electrode-less fluorescent lamp of the present invention shown in FIG. 4 includes two U-shaped tubular parts having two straight tubular parts 121, 122 and a curved tubular part 125, respectively, forming a closed curve through a connecting tubular part 128 at the lower end of the lamp.

In the above, "the straight tubular part" is defined as a straight part of the U-shaped tubular part, "the curved tubular part" is defined as a bent part of the U-shaped tubular part positioned between the two straight parts, and "the connecting part" is defined as a part connecting corresponding both ends of two different discharge tubes respectively. In the above, the straight tubular part, the curved part, and the connecting part are separated in order to explain the structure of the discharge tube, and therefore they are not independent structures but may be formed by a single tube in a practical manufacturing process. In the following embodiments, the name of the each part will be used as the same meaning.

Figure 5A:
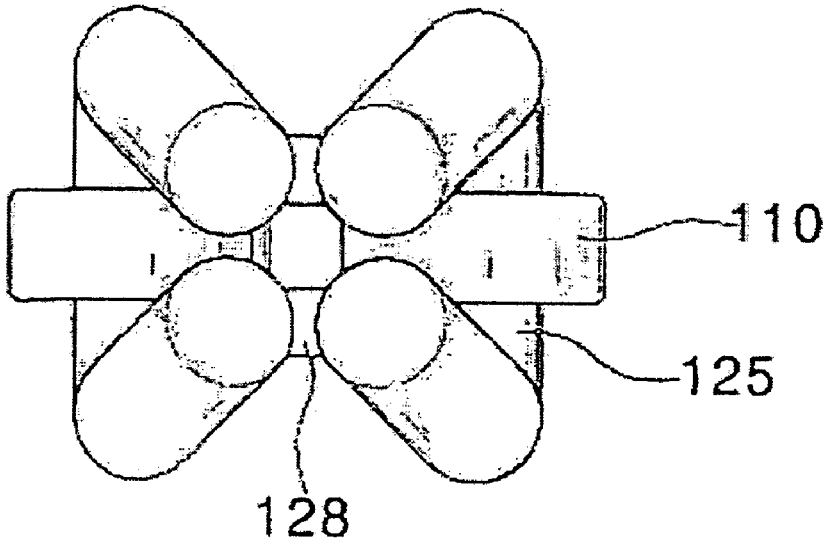
FIGS. 5*a*–5*c* are schematic diagrams showing an electrode-less fluorescent lamp in accordance with a third embodiment of the present invention.
Figure 5B:
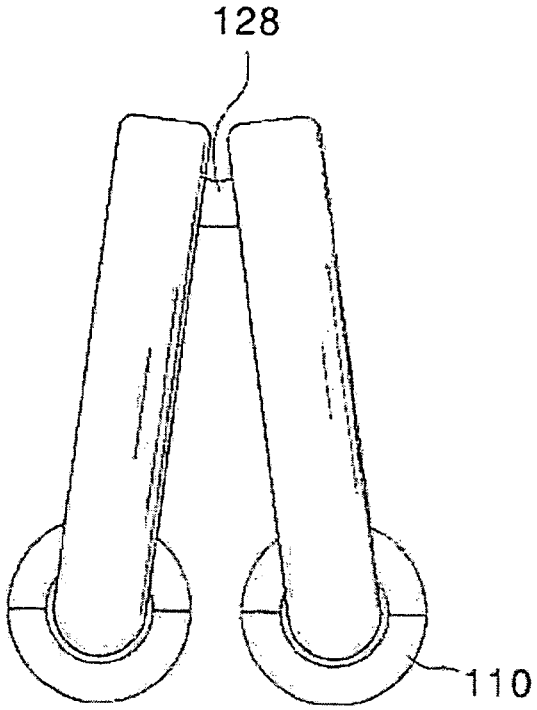
Figure 5C:
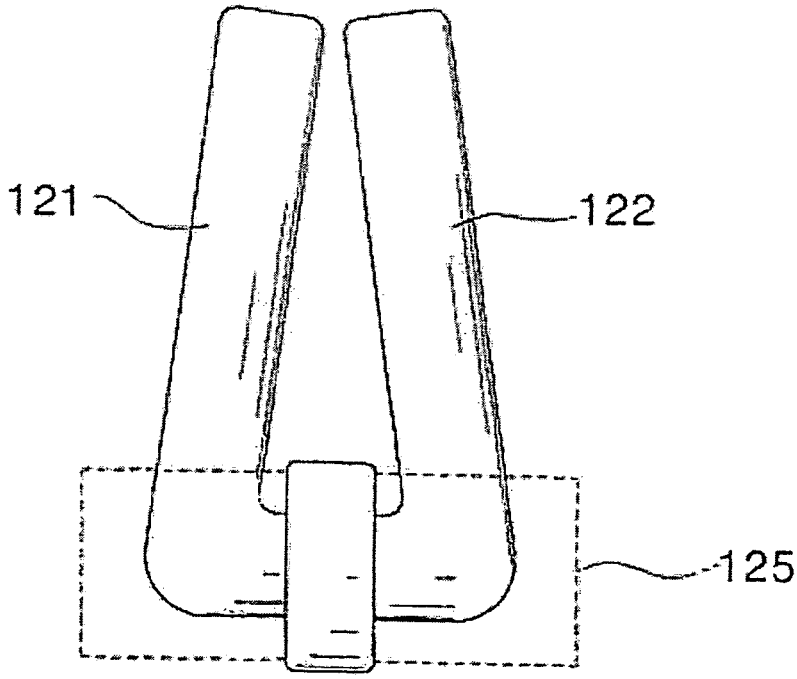

FIG. 5 is a schematic diagram showing a configuration of an electrode-less fluorescent lamp in accordance with yet another embodiment of the present invention. In accordance with another embodiment, FIG. 5 is showing a plane view (see FIG. 5*a*), a front view (see FIG. 5*b*), and a side view (see FIG. 5*c*) of the configuration including a discharge tube 120 and a core 110 of an electrode-less fluorescent lamp which are coupled to each other.

The electrode-less fluorescent lamp of the present invention shown in FIG. 5 includes two U-shaped tubular parts having two straight tubular parts 121, 122 and a curved tubular part 125, respectively, forming a closed curve through a connecting tubular part 128 positioned at the upper end of the lamp, but unlike the conventional U-shaped tube including two straight tubular parts parallel to each other shown in FIG. 4, the U-shaped tubes include two straight tubular parts leaning at a predetermined angle inward (toward the direction wherein ends of the two U-shaped tubes come closer to each other) and also themselves lean at a predetermined angle inward.

Like this, a primary effect improving the feature of light distribution can be achieved by leaning straight tubular parts at a predetermined angle inward. The improving effect of the feature of light distribution like this is shown in FIG. 6.

Figure 6A:
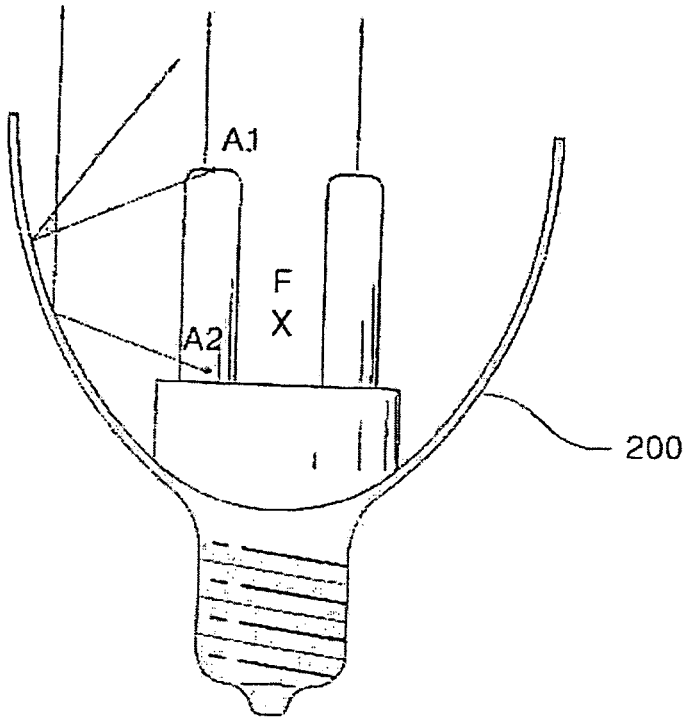
FIGS. 6*a* and 6*b* are partially sectioned views of electrode-less fluorescent lamps in accordance with embodiments of the present invention, showing light distribution.

FIG. 6*a* is showing a case installing a straight-line type lamp in a lighting system having a parabolic reflector used in the conventional incandescent lamp. Because the electrode-less fluorescent lamp is practically an area light source having a predetermined length unlike the incandescent lamp practically considered as a point light source, the light produced on the lateral face of the lamp cannot be emitted directly to the front face. The light is reflected by the reflector, and advances. However, the reflectivity of the reflector cannot be 100%, so it causes lighting efficiency to decrease.

Figure 6B:
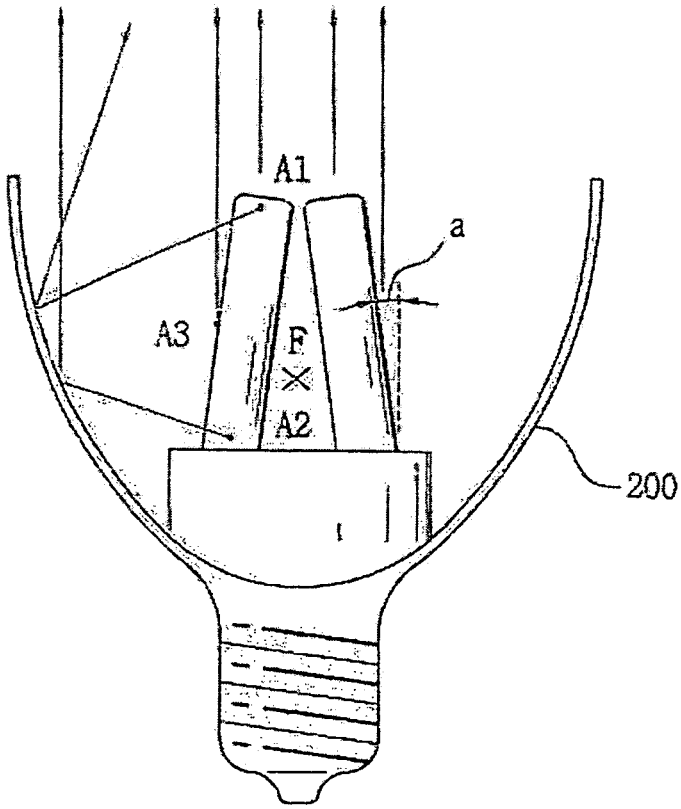

FIG. 6*b* is showing a case installing a fluorescent lamp of the present embodiment. In a case using a discharge tube leaning at a predetermined angle "a" inward, light produced on the lateral face of the lamp can directly advance to the front face of the lamp without being reflected by the reflector, thus the effect improving the lighting efficiency can be achieved. In addition, while in a case the point producing light is out of the focus like A1 in FIG. 6*a*, the light reflected on the reflector can be emitted without directivity, in a case using a discharge tube leaning inward the light reflected on the reflector can be faced to the front of the lamp more than that in FIG. 6*a*. Therefore, the directivity of lighting can be improved. Particularly, an advantageous effect is found in a local lighting and a down lighting.

In the present embodiment, as described in the above, the shape leaning at a predetermined angle inward is described. Nevertheless, it is needless to say that a shape having two straight tubular parts 121, 122 parallel to each other, U-shaped tubular parts themselves not leaning but parallel to each other, or two U-shaped tubular parts leaning at a predetermined angle even outward falls within the scope of the present invention, and the shape having leaning straight tubular parts 121, 122 or leaning U-shaped tubular parts in the drawings is just a preferred embodiment for illustrating a feature of the present invention.

FIG. 7 is a schematic diagram showing the configuration of an electrode-less fluorescent lamp in accordance with yet another embodiment of the present invention.

As shown in FIG. 7, the lamp has a structure coupling two U-shaped tubular parts to each other using a connecting part. The lamp may have a structure including two U-shaped tubular parts leaning at a predetermined angle inward, similarly, with reference to FIG. 5.

In the embodiments of FIG. 4 to FIG. 7, only a structure coupling two U-shaped tubular parts is described. Nevertheless, the scope of the present invention is not limited by the above embodiments. Also, a structure where three or more U-shaped tubular parts are coupled together may also be embodied.

Figure 7A:
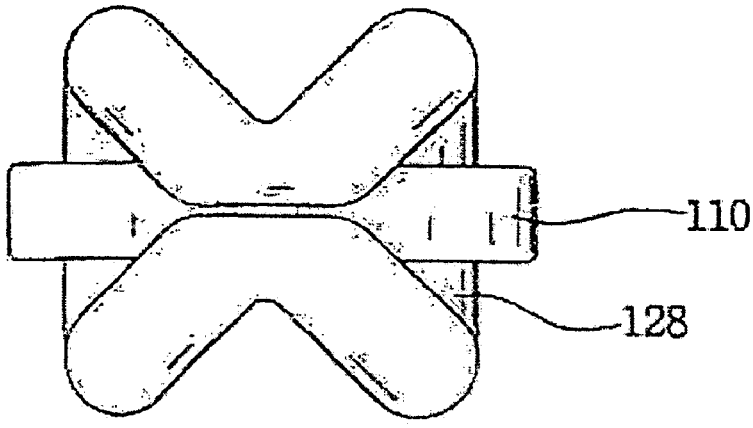
FIGS. 7*a*–7*d* are schematic diagrams showing an electrode-less fluorescent lamp in accordance with a fourth embodiment of the present invention.
Figure 7B:
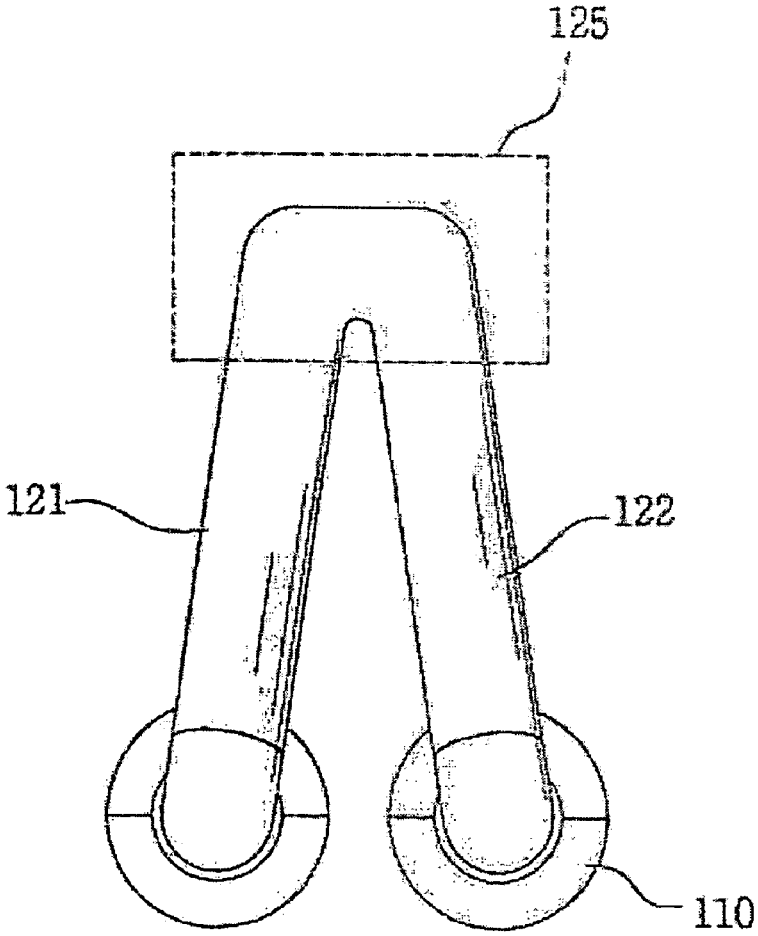
Figure 7C:
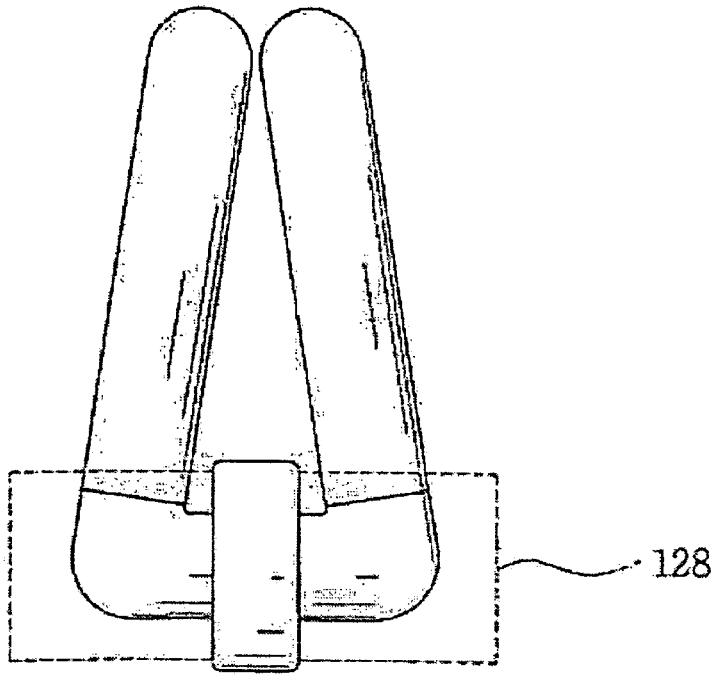
Figure 7D:
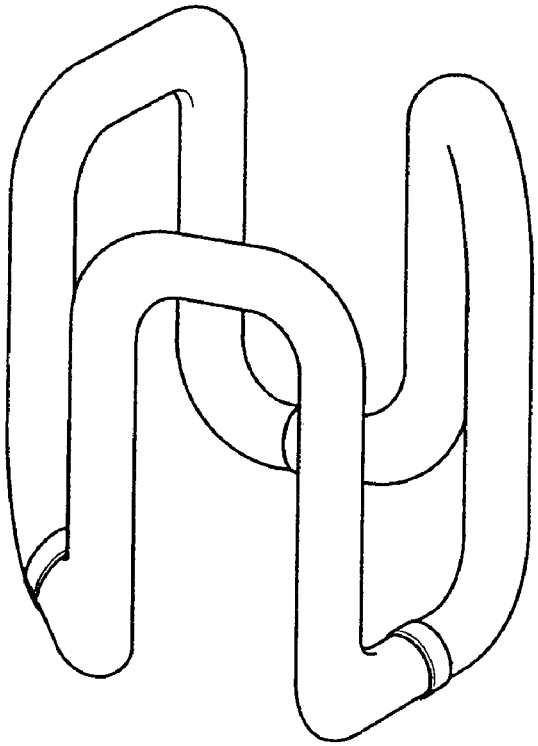

FIG. 7*d* is a diagram showing structure coupling three U-shaped tubular parts. Besides, various structures can be configured with reference to the embodiments in FIG. 4 to FIG. 7, too.

FIG. 8 is showing another embodiment having a structure twisted spirally.

Figure 8A:
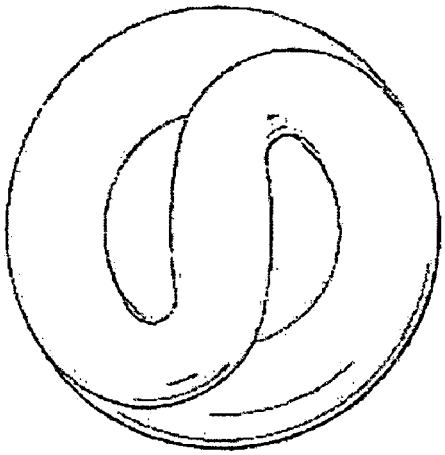
FIGS. 8*a*–8*d* are schematic diagrams showing an electrode-less fluorescent lamp in accordance with a fifth embodiment of the present invention.
Figure 8B:
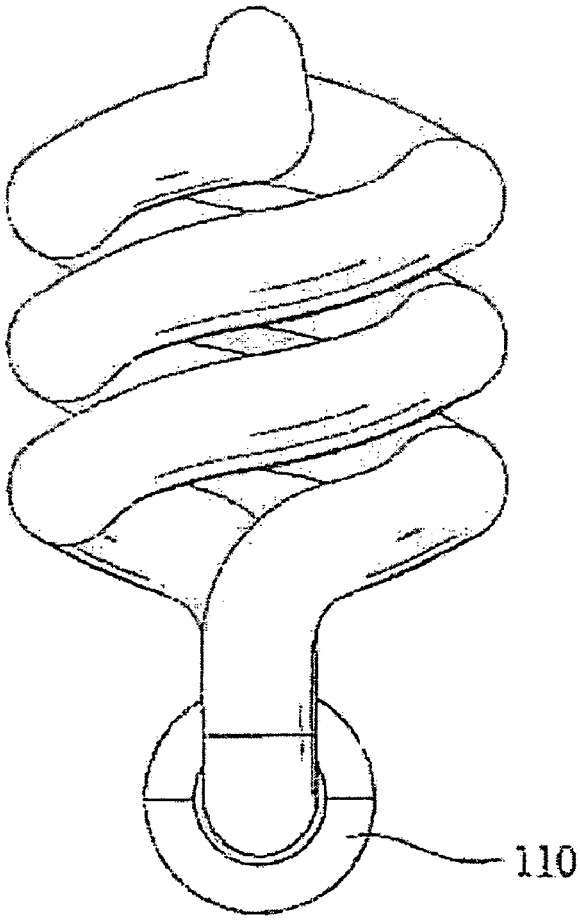
Figure 8C:
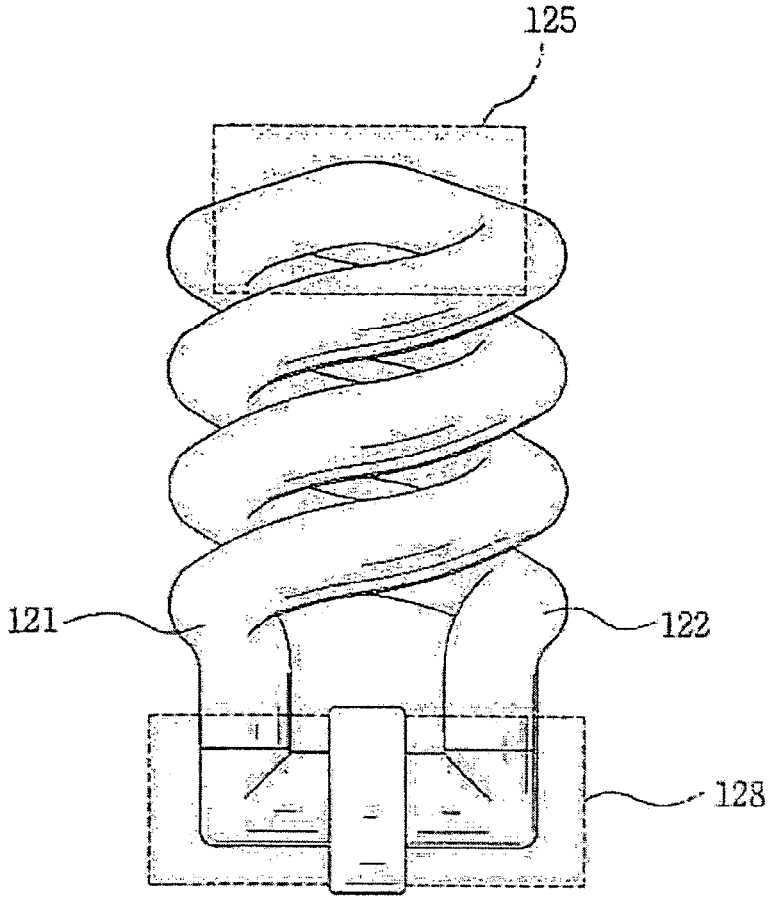

FIG. 8 is showing a plane view FIG. 8*a*, a front view FIG. 8*b* and a side view FIG. 8*c* of a structure coupling the discharge tube and the core of the electrode-less fluorescent lamp together in accordance with the present embodiment.

Because a spiral structure like the present embodiment can have the longest length in a coincidental volume, the structure is appropriate in application of high output. In the present embodiment, two spiral tubular parts twisted together have a double-coil shape, and are connected through a curved tubular part 125 at the upper end. In addition, the two spiral tubular parts form a closed-loop through a connecting part 128 at the lower end, and a core 110 is coupled to this connecting part 128. The two spiral tubular parts and the curved tubular part are connected to one another, and thus form one spiral structure. The spiral tubular part and the curved tubular part are separated not physically but for the convenience of describing.

In the above, the two spiral tubular parts twisted together and the connecting part can not only form a single tube, but also independent parts in a practical manufacturing process, respectively. In the following embodiments, the spiral tubular part and the connecting part will be used as the same meaning.

Figure 8D:
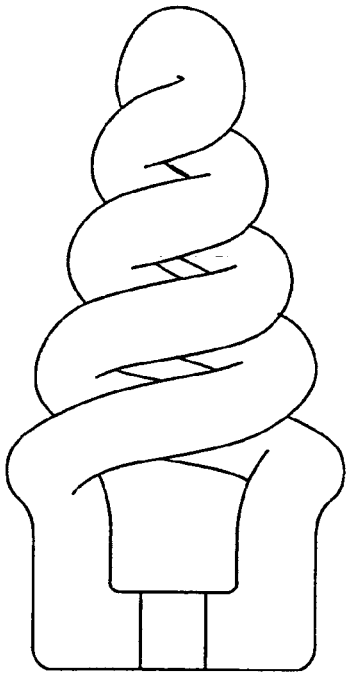

FIG. 8*d* is showing yet another embodiment, and the discharge tube has a structure wherein the spiral tubular parts go narrower with regard to a predetermined angle along the longitudinal direction toward the curved tubular part. Therefore, the light distribution characteristic can be improved. The improving effect of the light distribution characteristic is similar to that shown in FIG. 6.

Figure 9A:
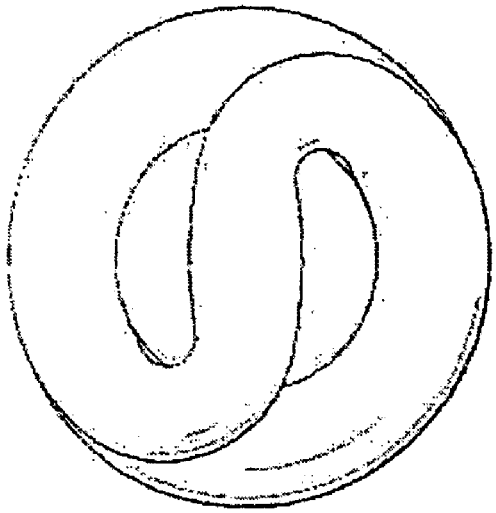
FIGS. 9*a*–9*c* are schematic diagrams showing an electrode-less fluorescent lamp in accordance with a sixth embodiment of the present invention.
Figure 9B:
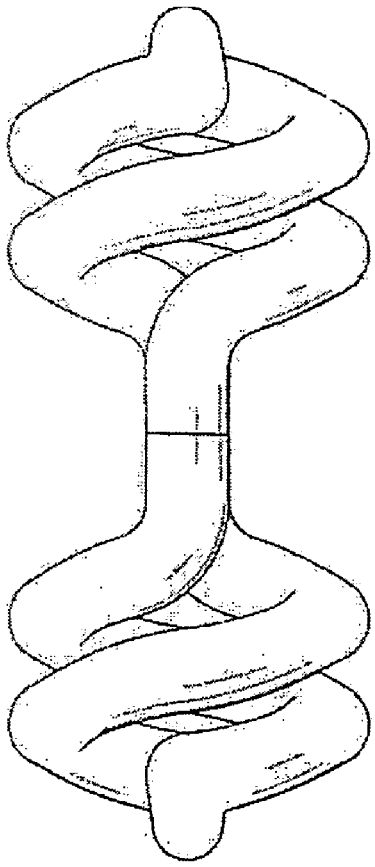
Figure 9C:
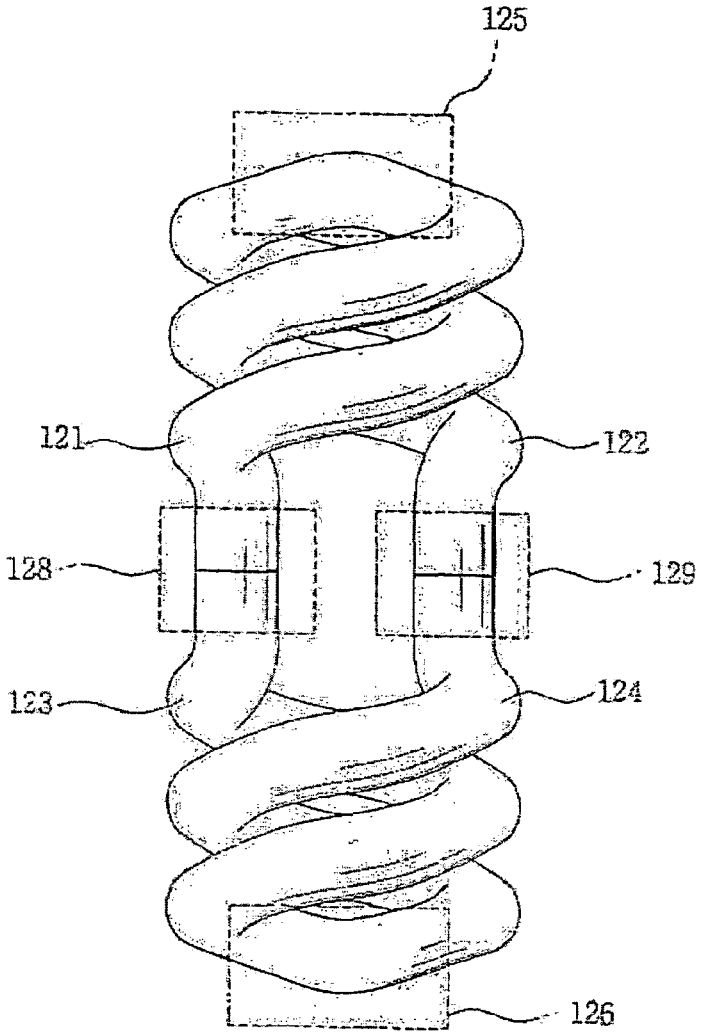

FIG. 9 is a schematic diagram showing a configuration of an electrode-less fluorescent lamp in accordance with yet another embodiment of the present invention. FIG. 9 is showing another embodiment wherein two spiral tubular parts twisted together, forming a double-coil shape explained in the above FIG. 8 are coupled to two coincidental spiral tubular parts such that a closed-loop is formed.

In the present embodiment, the discharge tube comprises a first spiral tubular part 121, a second spiral tubular part 122 twisted with the first spiral tubular part 121 to form a double-coil shape, a first curved tubular part 125 connecting one end of the first spiral tubular part 121 and one end of the second tubular part 122, a third spiral tubular part 123, a fourth spiral tubular part 124 twisted with the third spiral tubular part to form a double-coil shape, a second curved tubular part 126 connecting one end of the third spiral tubular part 123 and one end of the fourth tubular part 124, a first connecting part 128 connecting the other end of the first spiral tubular part 121 and the other end of the third spiral tubular part 123, surrounded partially by one of the cores, and a second connecting part 129 connecting the other end of the second spiral tubular part 122 and the other end of the fourth spiral tubular part 124, surrounded partially by the other of the cores. Thus the discharge tube forms a closed-loop entirely, and has a 3-D structure. It is clear like shown in the above that the spiral tubular part, the curved tubular part, and the connecting part are separated for the convenience of describing, but can form a single discharge tube in a practical manufacturing process.

Figure 10:
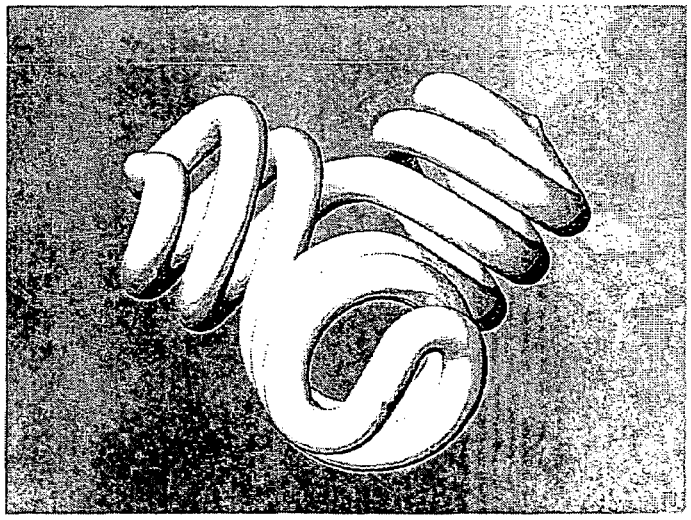
FIG. 10 is a schematic diagram showing an electrode-less fluorescent lamp in accordance with a seventh embodiment of the present invention.

FIG. 10 is a schematic diagram showing a configuration of an electrode-less fluorescent lamp in accordance with yet another embodiment of the present invention. Further, FIG. 10 is showing yet another embodiment of the above FIG. 8.

FIG. 10 is showing a structure which couples two spiral tubular parts twisted with each other to form a double-coil shape and another two spiral tubular parts having the same shape together, and thus forms a closed-loop. Also, the same principle as that of the scope of the present invention explained in detail with reference to FIG. 8 is applied to an embodiment shown in FIG. 10, thus detailed explanation is omitted.

In the above embodiments until here, formation of the discharge tube has been explained with functions as the central figure, and by separating the entire shape of the discharge tube into parts. This is only for the convenience of understanding and describing, but not for showing a unit of each part in the manufacturing process. For example, in the above embodiments, the first spiral tubular part 121, the second spiral tubular part 122, and etc cannot only be manufactured by bending a single tube, but also by coupling several tubes bent in advance or by bending several tubes coupled together in advance.

In addition, in the above embodiments, it is clear that the curved tubular part 125 and etc are not for showing that the parts are independent physically, but for the convenience of describing parts used for only connection.

Now, a manufacturing process will be described with reference to drawings.

FIG. 11 is a schematic diagram showing a manufacturing process of an electrode-less fluorescent lamp having a 3-dimensional structure in accordance with an embodiment of the present invention.

Figure 11A:
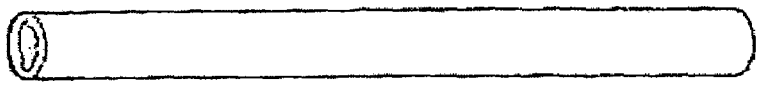
FIGS. 11*a*–11*k* are schematic diagrams showing a manufacturing process of an electrode-less fluorescent lamp having a 3-dimensional structure in accordance with a first embodiment of the present invention.

A discharge tube is an electric tube enclosing gases. In the following, a manufacturing process of the fluorescent lamp will be explained with a process manufacturing the discharge tube as the central figure. FIG. 11*a* is a diagram showing a material tube for the discharge tube (hereinafter referred to as "a material tube") cut to a predetermined length.

The material tube is preferred to be light-transmissive and easy in manufacturing. Glass tubes have been used conventionally. Generally, soda glass and potassium glass are used for the material tube, and further boron-silica glass, aluminum silicate, aluminum silica, and quartz-glass may be used. Besides, other appropriate materials may be used for the material tube, and the present invention is not limited by the above examples.

In the following, a manufacturing process of the electrode-less fluorescent lamp shown in FIG. 11 will be described in detail.

Figure 11B:
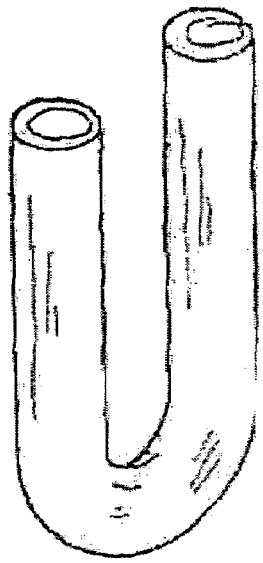

A first bending process is performed that a material tube cut to a predetermined length is bent to form a U-shape (see FIG. 11*b*).

In the first bending process, two straight tubular parts may be parallel together, form an acute angle to each other, or form an obtuse angle to each other. In the following, all cases noted in the above will be considered in the first bending process.

A fluorescent layer coats on the inner surface of the material tube bent into a U-shape. The fluorescent layer includes settling agents, adhesives, solvents, fluorescents, dispersing agents, and etc.

After completing the coating process, a second bending process is performed that each portion of straight tubular parts having a predetermined length measured from at each end is bent at a predetermined angle to the closed curved surface formed by a center-line of the U-shaped tube to form connecting parts.

"The connecting part" indicates a portion connecting ends of different two U-shaped tubular parts as described in the above embodiment of FIG. 4. In the present embodiment, the connecting part is a portion connecting two different U-shaped tubular parts.

In the second bending process, the connecting parts may be bent at a right angle, an acute angle, or an obtuse angle to the closed curved surface formed by the center-line of the U-shaped tube.

Preferably, if the second bending process is performed to form an acute angle, a configuration like the above FIG. 5 may be achieved, and thus a primary effect improving the feature of light distribution is achieved by leaning the straight tubular parts 121, 122 at a predetermined angle inward.

After the second bending process, an exhaust tube forming process is performed in order to exhaust inside of the discharge tube. In this case, the exhaust tube may be formed by being attached to an exhaust hole preformed in the material tube, or by being extracted shortly from the material tube with forming the exhaust hole. For the convenience of an exhausting and the introducing gases process, to attach the exhaust tube having a predetermined length is preferred and also conventional in the present embodiment.

Figure 11C:
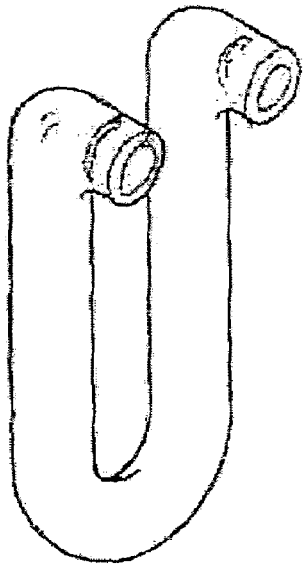
Figure 11D:
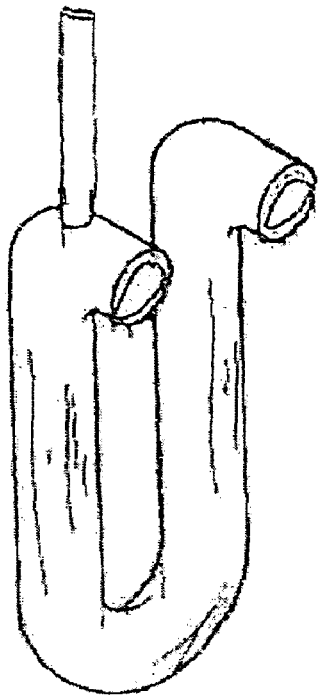

In accordance with the present invention, the first bending process, the coating process, and the second bending process are repeated to manufacture second material tube having a predetermined length indicated in FIG. 11*c*.

Figure 11E:
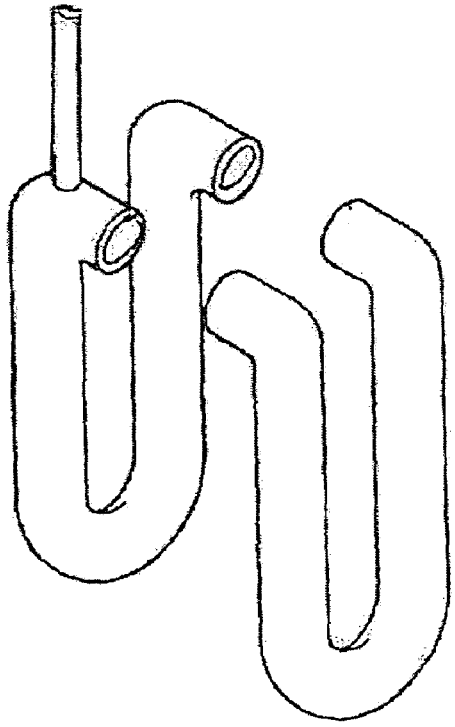
Figure 11F:
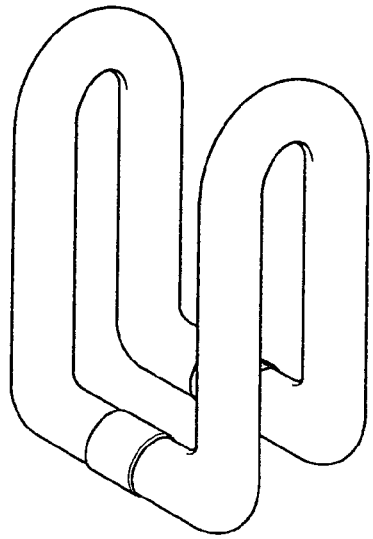

A material tube coupling process is performed that the material tubes are coupled together at corresponding ends as shown in FIG. 11*e*.

An exhausting and introducing process is performed that the inside of the first and second material tube coupled together is exhausted and gases are introduced through the exhaust tube. Next, the exhaust tube is removed.

If the processes of FIG. 11*a* to FIG. 11*e* is performed and a 3-D, solid-structure shape is formed by coupling two U-shaped material tubes, manufacturing an electrode-less fluorescent lamp may be completed by installing cores and coils in a predetermined region in the coupled material tubes.

Figure 11G:
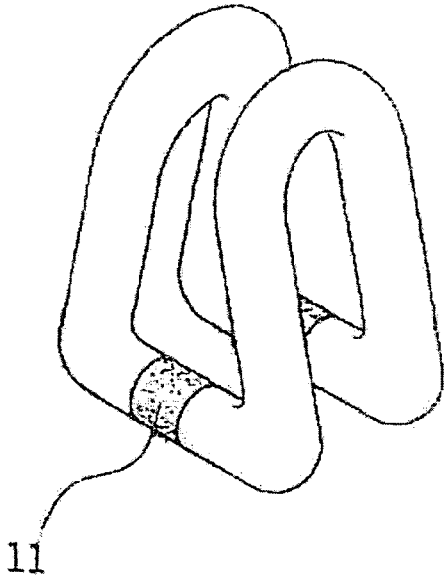
Figure 11H:
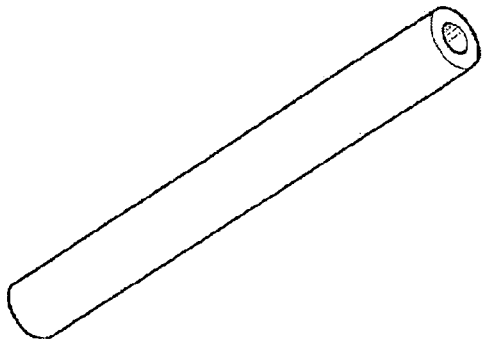

On the one hand, the structure of FIG. 11*g* is transformed from that of FIG. 11*e* in order to improve the intensity of illumination and the efficiency of the fluorescent lamp with considering linearity of light of the fluorescent lamp. The structure of FIG. 11*g* may be configured in the way that in the second bending process, the connecting part is bent more largely to form an acute angle to the closed curved surface.

On the other hand, even if the second bending process (see FIG. 11*c*) is following the coupling process (see FIG. 11*e*) unlike the above sequence of the processes, the same result may be achieved. That is, if the U-shaped material tubes are formed through the first bending process at first, then a fluorescent layer coats on the inner surface of the material tubes, next the material tubes are coupled together at the corresponding ends, and finally the second bending process is performed to form the shape of FIG. 11*f* or FIG. 11*g*, the electrode-less fluorescent lamp having the same shape as the aforementioned embodiment may be manufactured.

Also, if the bending process is performed after two material tubes are coupled together, the same result may be achieved. That is, the coating process is performed to a material tube in FIG. 11*h*, and then a coupling part is formed (see FIG. 11*i*).

Figure 11I:
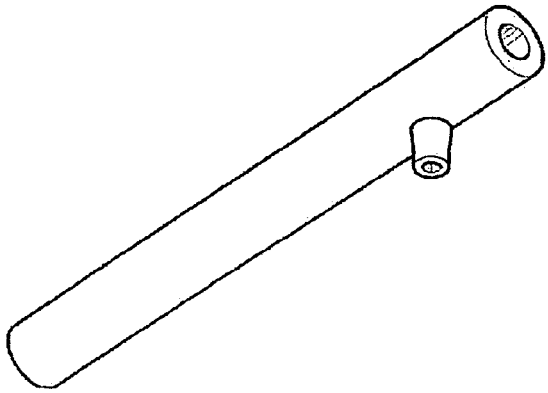
Figure 11J:
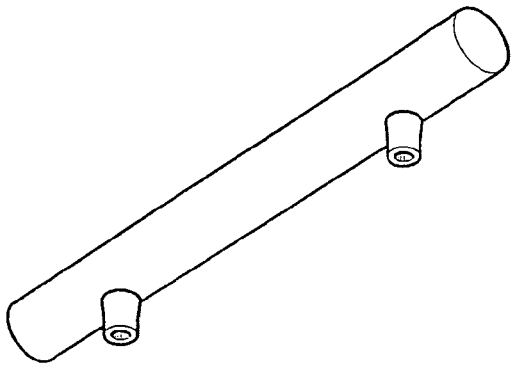

Both ends of the material tube having the coupling parts are sealed (see FIG. 11*j*).

Figure 11K:
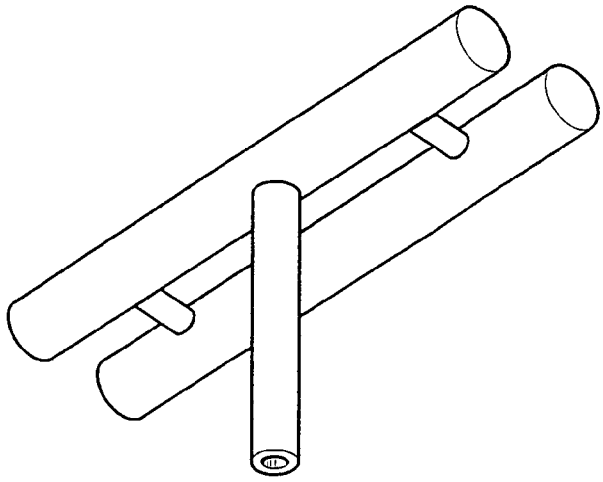

After a second material tube is manufactured in the same manner as FIG. 11*i* and FIG. 11*j*, the both material tubes are coupled together at the corresponding coupling parts (see FIG. 11*k*).

An exhaust tube is formed, and the material tubes coupled together are bent into U-shapes. The following processes, such as an exhausting and introducing gases process, an exhaust tube removing process, and an cores and coils installing process, are the same as the above. In this way, an electrode-less fluorescent lamp having the same shape as the above may be achieved.

Besides, if the exhaust tube removing process is performed in the material tube coupling process after a second material tube having an attached exhaust tube is manufactured in the second material tube manufacturing process, an electrode-less fluorescent lamp having the same shape as the above embodiment may be achieved.

FIG. 12 is a schematic diagram showing a manufacturing process of an electrode-less fluorescent lamp having a 3-dimensional structure in accordance with another embodiment of the present invention.

Figure 12A:
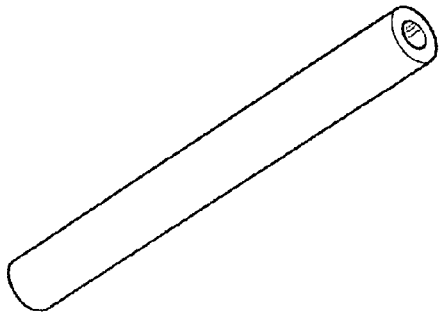
FIGS. 12*a*–12*h* are schematic diagrams showing a manufacturing process of an electrode-less fluorescent lamp having a 3-dimensional structure in accordance with a second embodiment of the present invention.
Figure 12B:
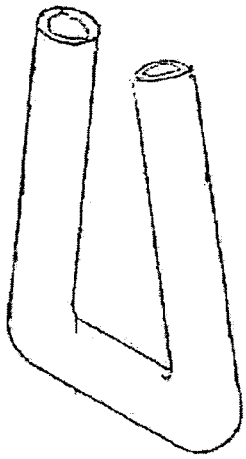
Figure 12C:
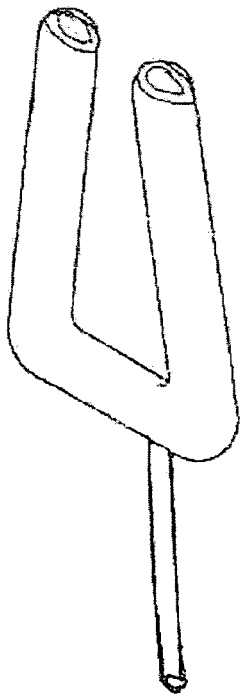
Figure 12D:
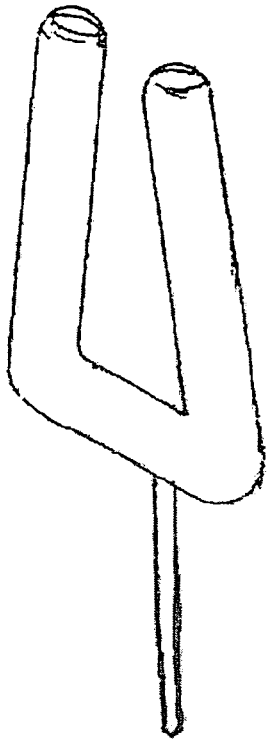
Figure 12E:
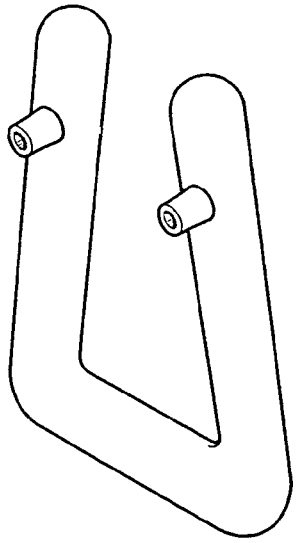

The processes in FIG. 12*a* to FIG. 12*c* are similar to the first bending process, the coating process, and the exhaust tube forming process as described in FIG. 11, thus detailed explanation is omitted. In the first bending process of the present embodiment, a U-shaped material tube having two straight tubular parts forming an acute angle is shown representatively, but a shape having two straight tubular parts parallel to each other or having straight tubular parts forming an obtuse angle may be considered, too.

After the first bending process, the coating process and the exhaust tube forming process are performed, the sealing process for sealing the first material tube at both ends is performed. The shape of sealed region is flat or dome-shape. Besides the shape may be various shapes depending on cases.

In order to fabricate a 3-D structure in the same manner as the embodiment noted in the above, a second material tube is manufactured by repeating the processes in FIG. 12*a* and FIG. 12*b*, then coupling parts is formed on the first and second material tubes. The coupling part including a coupling hole and a protruded portion should form a protruded shape in order to couple the material tubes to each other.

Figure 12F:
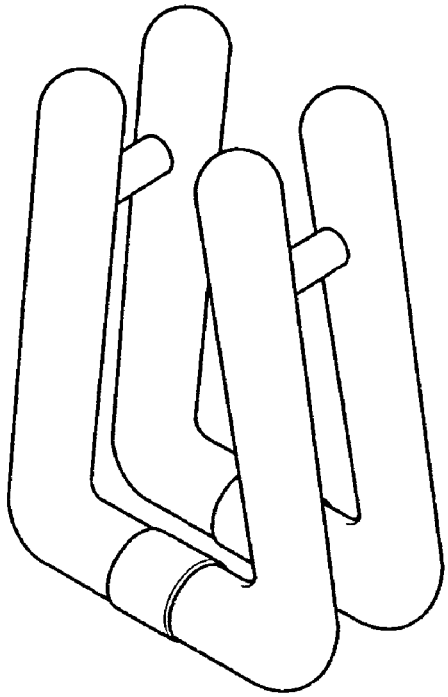

After the coupling part forming process, the material tubes are coupled to each other at the corresponding ends (see FIG. 12*f*).

The inside of the first and second material tube is exhausted through the exhaust tube, then a predetermined discharge gas is introduced, and finally the exhaust tube is removed.

Figure 12G:
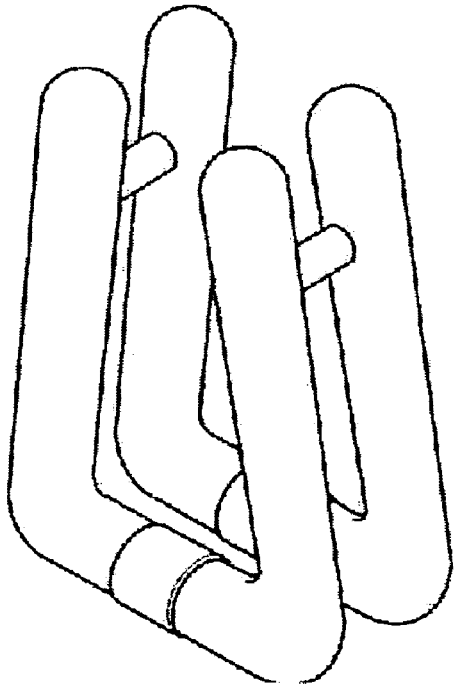

If the processes of FIG. 12*a* to FIG. 12*f* is performed and a 3-D, solid-structure shape is formed by coupling two U-shaped material tubes together as shown in FIG. 12*g*, manufacturing an electrode-less fluorescent lamp may be completed by installing cores and coils on a predetermined region 11 of the coupled material tubes.

Figure 12H:
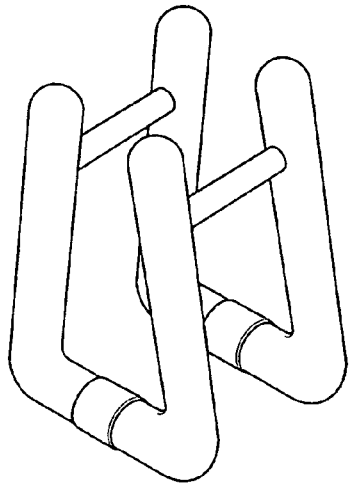

FIG. 12*h* is a diagram showing yet another embodiment coupling the material tubes together using connecting tubes in the coupling process using the coupling holes. In the above, "the connecting tube" is defined as a part connecting different discharge tubes at both ends.

In the material tube coupling process, an electrode-less fluorescent lamp may be manufactured in the way that coupling holes are formed at predetermined region on the first and second material tube, and the material tubes are coupled together through the connecting tubes at the corresponding ends.

If the connecting tubes are bent through the second bending process as shown in FIG. 12*i*, both ends of each discharge tube may become closer to the central axis of the fluorescent lamp like those in FIG. 12*f*. In this case, the intensity of illumination and the efficiency of the fluorescent lamp may be improved in response to straightness of light from the fluorescent lamp, in the same manner as the embodiment noted in the above.

FIG. 13 is a schematic diagram showing a manufacturing process of an electrode-less fluorescent lamp having a 3-dimensional structure in accordance with yet another embodiment of the present invention.

In a first bending process of the present embodiment, a U-shaped material tube having two straight tubular parts forming an obtuse angle is shown representatively.

A coating process coating a fluorescent layer on the inner surface of the material tube bent into a U-shape and a second material tube manufacturing process repeating the first bending process and the coating process to manufacture a second material tube are the same as in FIG. 11.

A connecting tube (see FIG. 13*c*) is cut to a predetermined length, and a connecting tube coating process is performed that the inner surface of a first and a second connecting tube are coated with a fluorescent layer.

Figure 13A:
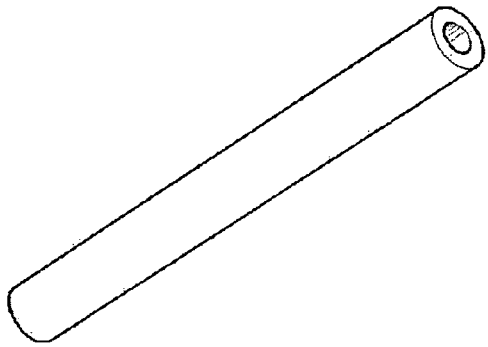
FIGS. 13*a*–13*h* are schematic diagrams showing a manufacturing process of an electrode-less fluorescent lamp having a 3-dimensional structure in accordance with a third embodiment of the present invention.
Figure 13B:
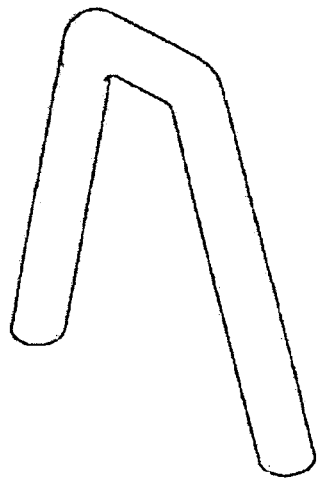
Figure 13C:
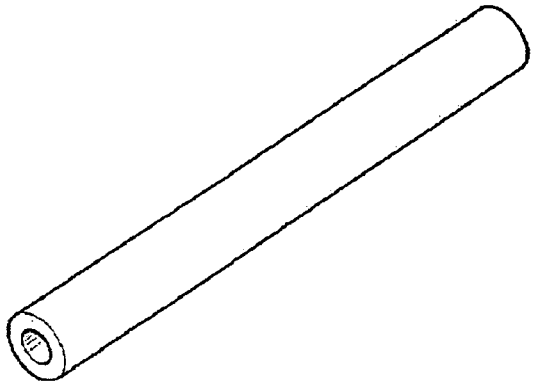
Figure 13D:
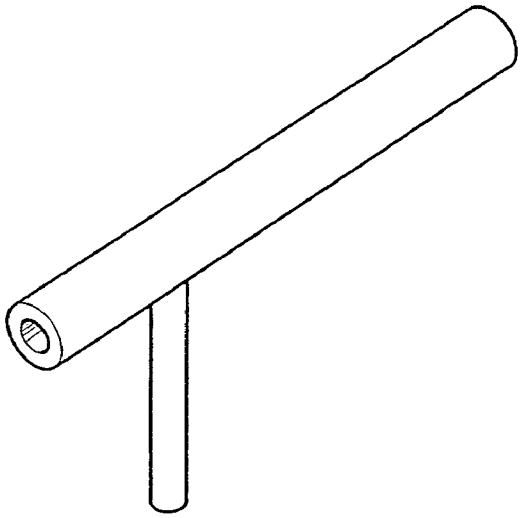
Figure 13E:
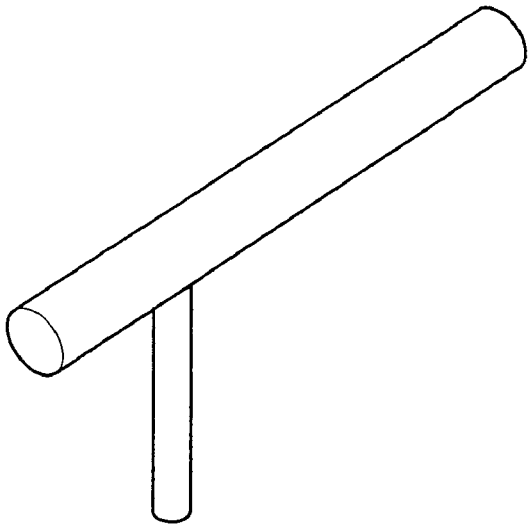

An exhaust tube forming process is performed that an exhaust tube is attached at a predetermined region of the first or second connection tube in order to exhaust inside of the connecting tubes and the material tubes, and then a sealing process sealing the connecting tubes at both ends is performed (see FIG. 13*e*). In the case sealing the connecting tube at both ends, the shape of sealed region is flat or a dome-shape like the embodiment noted in the above. Besides the shape may be various depending on cases.

Figure 13F:
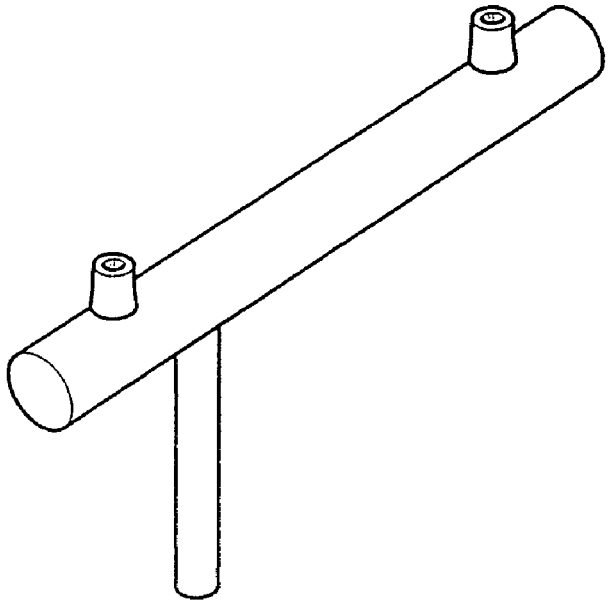
Figure 13G:
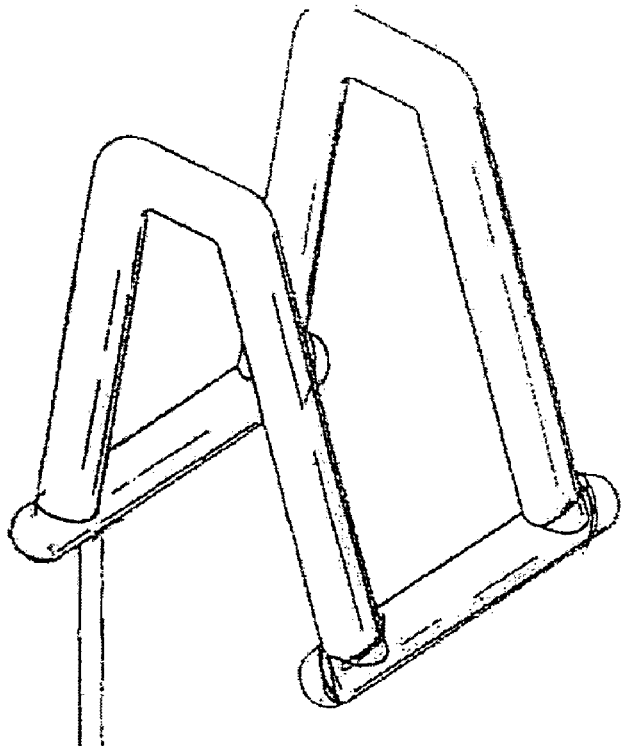

Coupling holes are formed at predetermined regions of the first and second connecting tubes in order to couple the first and second material tubes to the first and second connecting tubes, respectively (see FIG. 13*f*). One end of the first material tube and one end of the second material tube are coupled to the first connecting tube at the corresponding coupling holes. The other end of the first material tube and the other end of the second material tube are coupled to the second connecting tube at the corresponding holes, too (see FIG. 13*g*).

The inside of the first and second material tubes and the first and second connecting tubes, coupled together, is exhausted and gases are introduced through the exhaust tube. Next, the exhaust tube is removed.

Figure 13H:
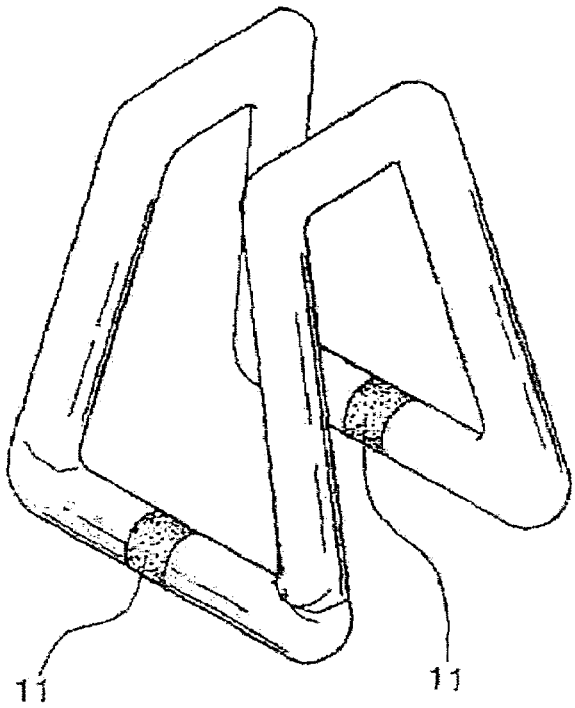

If a 3-D, solid-structure shape is formed by coupling two U-shaped material tubes together with the connecting tubes as shown in FIG. 13*h*, manufacturing an electrode-less fluorescent lamp having a 3-D structure may be completed by installing cores and coils on a predetermined region 11 of the coupled material tubes.

In accordance with yet another embodiment, a fluorescent lamp may be manufactured by using only one material tube. A manufacturing process will be explained in the following.

A first bending process is performed that a material tube having a predetermined length is bent to form an oval-shaped tube, then the inner surface of the material tube is coated with a fluorescent layer, and finally both ends of the material tube is coupled together to provide an closed-loop and oval-shaped tube.

In the first bending process, a circle-shape may be utilized, too.

An exhaust tube is formed on a predetermined region in the closed-loop and oval-shaped material tube. A second bending process is performed so that each of two U-shaped portions having the same shapes and lengths in the material tube is bent at a predetermined angle.

Inside of the material tube having a closed-loop and oval shape is exhausted and gases are introduced through the exhaust tube. Next, the exhaust tube is removed.

If a closed-loop, 3-D, solid-structure shape is formed in the above way, manufacturing an electrode-less fluorescent lamp having a 3-D structure may be completed by installing cores and coils on a predetermined region of the coupled material tubes.

Figure 14A:
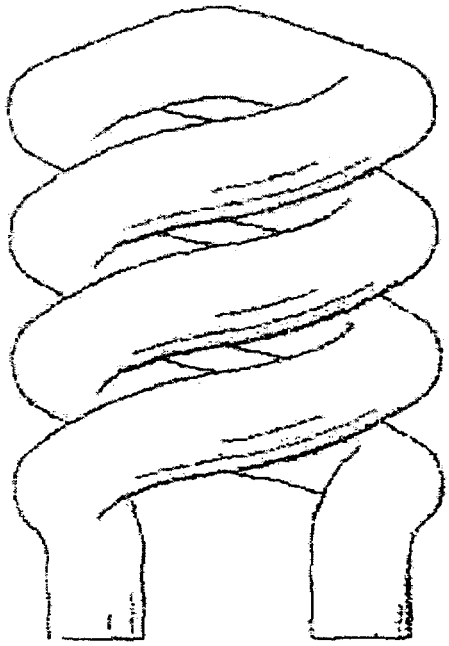
FIGS. 14*a*–14*c* are schematic diagrams showing a manufacturing process of an electrode-less fluorescent lamp having a 3-dimensional structure in accordance with a fourth embodiment of the present invention.
Figure 14B:
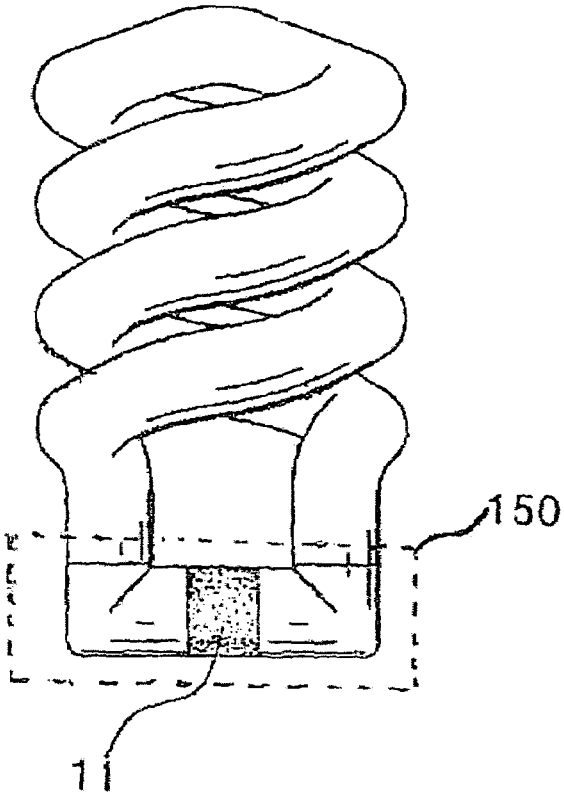

FIG. 14 is a schematic diagram showing a manufacturing process of an electrode-less fluorescent lamp having a 3-dimensional structure in accordance with yet another embodiment of the present invention.

A material tube like noted in FIG. 13*a* is manufactured to form a spiral structure as shown in FIG. 14*a*, and the inner surface of the material tube is coated with a fluorescent layer.

Then, a coating process, an exhaust tube forming process, a sealing process, and a coupling hole forming process (see FIG. 13*c* to FIG. 13*d*) are performed on an intervening tube in order. In the above, "the intervening tube" is defined as a part connecting both ends of a discharge tube.

Processes shown in FIG. 13, such as a material tube coupling process, an exhausting and the introducing gases process, an exhaust tube removing process, and an cores and coils installing process are performed in the same manner as the above. In this way, an electrode-less fluorescent lamp having the a 3-D structure may be achieved.

Figure 14C:
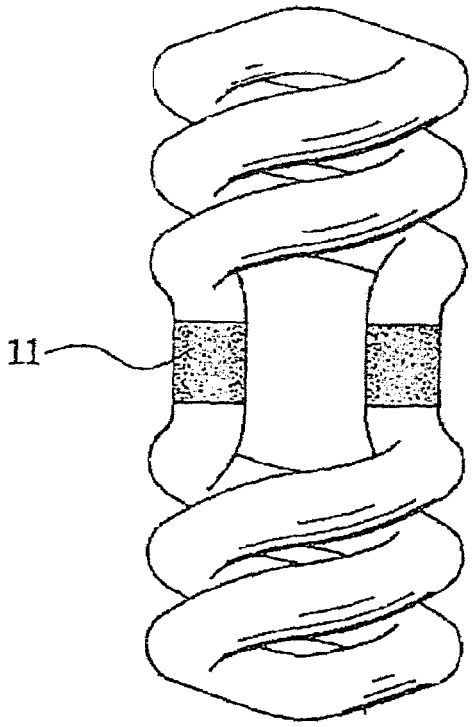
Figure 15A:
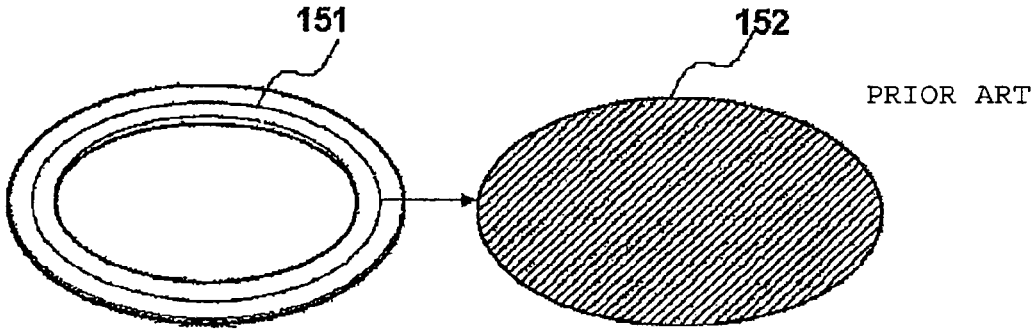
FIG. 15*a* is a schematic diagram showing a closed-curved-surface formed by a discharge tube of a 2-dimentional electrode-less fluorescent lamp.
Figure 15B:
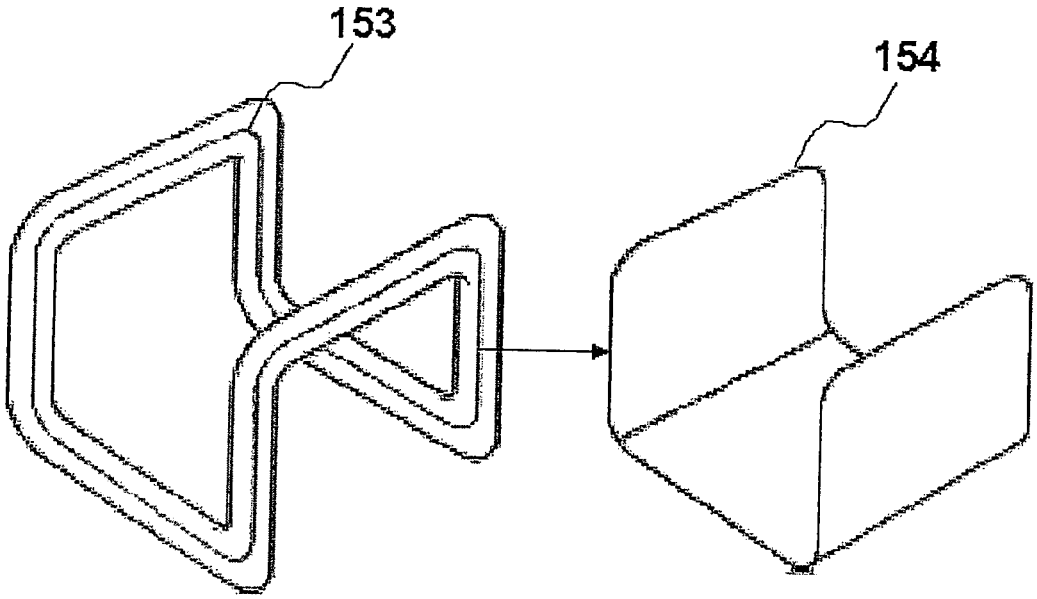
FIG. 15*b* is a schematic diagram showing a virtual closed-curve and a virtual closed-curved-surface formed by a discharge tube of an electrode-less fluorescent lamp having a 3-dimensional structure in accordance with a first embodiment of the present invention.

In addition, an electrode-less fluorescent lamp having a 3-D structure like shown in FIG. 14*c* may be manufactured, by using two spiral material tubes like shown in FIG. 14*a* and by coupling them together at both ends, respectively, instead of using the intervening tube 150.

In accordance with another aspect of the present embodiment, various modifications may be utilized by coupling several spiral tubes together.

On the one hand, in the coupling method with regard to the coupling the material tubes or the material tube and the intervening tube, the general melting coupling method can be used. Also, water glass can be used. Because water glass has a relatively low melting point, using water glass is easier in the coupling process than the general melting coupling method.

On the other hand, in the 3-D, electrode-less fluorescent lamp in accordance with each of the embodiments, in order to operate the lamp, cores 110, coils 130, and etc should be disposed in a predetermined region in the discharge tube, and RF source 140 converting commercial supply power into radio frequency power should be connected to the coils. FIG. 3 is showing a fluorescent lamp having a structure like in FIG. 12*f* as an example.

The RF source 140 can be configured with the electrode-less fluorescent lamp as one body, but also can be configured separately. In order to substitute an electrode-less fluorescent lamp of the present invention for the conventional incandescent lamp or the conventional high output lamp easily, it is desirable that RF source is configured with the discharge tube 120, the core 110 and the coil 130 as one body. A socket is an inlet for supplying electricity to a bulb, a fluorescent lamp, and a vacuum tube as well as equipment for sustaining them. There are an Edison-type and a Swan-type according to installing methods. The Edison-type is used popularly in domestic wiring of houses, and is called a socket in general. In order to make it easy to be joined with a general socket for an incandescent lamp, the electrode-less fluorescent lamp of the present invention is preferred to have an extra connecting part shaped a screw.

The afore-mentioned embodiments and drawings do not limit the scope of the present invention, but are used for the purpose of explaining the present invention. That various modification or improvements within the scope of the present invention is possible is clearly understood to a person skilled in the art.

For example, that the electrode-less fluorescent lamp having a 3-D structure can have a more complex shape than a spiral shape, such as a shape adding a straight line to a spiral shape, or etc, is clearly understood to a person skilled in the art. Therefore this case also falls within the scope of the present invention.

In addition, it is not an important factor whether or not the electrode-less fluorescent or the present invention is configured as one body or by several parts which can be separated from one another in order to determine if the lamp falls within the scope of the present invention, and may be considered as one of modifications of the present invention.

It should be noted that the scope of the present invention is not limited to the described embodiments. That various modification or improvements to the described embodiments is possible is clearly understood to a person skilled in the art. It is clear that the modification and improvements also fall within the scope of the present invention. Thus, it is intended that the scope of the invention be determined solely by the equal scope of the appended claims as well as the appended claims.

INDUSTRIAL APPLICABILITY

In accordance with the present invention, it is possible to use an electrode-less fluorescent lamp having a 3-D structure in a lighting system for the conventional incandescent lamp or high output lamp without changeover, and to provide a new electrode-less fluorescent lamp having a tubular 3-D solid structure which can be manufactured easily.

The invention claimed is:

1. An electrode-less fluorescent lamp having a 3-D structure comprising:

a closed-loop tubular discharge tube enclosing a discharge gas, said tube being coated with a fluorescent layer on an inner surface and made of a light-transmissive material, wherein a center-line through said discharge tube forms a virtual closed-curved-surface of a 3-D structure in a 3-D space;

at least one core surrounding at least a portion of said discharge tube;

at least one coil wound around said at least one core, said coil supplying electromagnetic power to said discharge tube by producing a time-varying magnetic field in said core; and a radio frequency (RF) power source supplying RF power to said coil so that discharge generated in said discharge tube is maintained by said RF power, wherein said RF power generated by said RF source is supplied to said coil, said time-varying magnetic field is induced by said RF power supplied, and said electromagnetic power is supplied to said discharge tube via induced magnetic field, wherein said closed-loop tubular discharge tube comprises:

two (2) U-shaped tubular parts; and a connecting part connecting said two U-shaped tubular parts to form a closed-loop, wherein said U-shaped tubular part comprises two straight tubular parts and a curved tubular part connecting said two straight tubular parts, said curved tubular part being at least partially surrounded by said core.

2. The electrode-less fluorescent lamp having a 3-D structure according to claim 1, wherein said two straight tubular parts of each of said two U-shaped tubular parts are not in parallel to each other and a distance between said two straight tubular parts becomes closer in a direction away from said connecting part of said U-shaped tubular part; and said two U-shaped tubular parts are not in parallel to each other, and a distance between said two U-shaped tubular parts becomes smaller in a direction away from said connecting part.

3. The electrode-less fluorescent lamp having a 3-D structure according to claim 1, wherein said discharge tube has a pressure equal to or greater than 0.5 Torr.

4. An electrode-less fluorescent lamp having a 3-D structure comprising:

a closed-loop tubular discharge tube enclosing a discharge gas, said tube being coated with a fluorescent layer on an inner surface and made of a light-transmissive material, wherein a center-line through said discharge tube forms a virtual closed-curved-surface of a 3-D structure in a 3-D space;

at least one core surrounding at least a portion of said discharge tube;

at least one coil wound around said at least one core, said coil supplying electromagnetic power to said discharge tube by producing a time-varying magnetic field in said core; and a radio frequency (RF) power source supplying RF power to said coil so that discharge generated in said discharge tube is maintained by said RF power, wherein said RF power generated by said RF source is supplied to said coil, said time-varying magnetic field is induced by said RF power supplied, and said electromagnetic power is supplied to said discharge tube via induced magnetic field;

wherein said closed-loop tubular discharge tube comprises:

two U-shaped tubular parts; and a connecting part connecting said two U-shaped tubular parts to form a closed-loop, said connecting part being at least partially surrounded by said core, wherein each of said two U-shaped tubular parts comprises two straight parts and a curved tubular part connecting said two straight parts so that has a 3-D structure.

5. The electrode-less fluorescent lamp having a 3-D structure according to claim 4, wherein said two straight tubular parts are not in parallel to each other, and a distance between said two straight tubular parts becomes closer in a direction away from said connecting part; and said two U-shaped tubular parts are not in parallel to each other, and a distance between said two U-shaped tubular parts becomes smaller in a direction away from said connecting part.

6. The electrode-less fluorescent lamp having a 3-D structure according to claim 4, wherein said discharge tube has a pressure equal to or greater than 0.5 Torr.

7. An electrode-less fluorescent lamp having a 3-D structure comprising:

a closed-loop tubular discharge tube enclosing a discharge gas, said tube being coated with a fluorescent layer on an inner surface and made of a light-transmissive material, wherein a center-line through said discharge tube forms a virtual closed-curved-surface of a 3-D structure in a 3-D space;

at least one core surrounding at least a portion of said discharge tube;

at least one coil wound around said at least one core, said coil supplying electromagnetic power to said discharge tube by producing a time-varying magnetic field in said core; and a radio frequency (RF) power source supplying RF power to said coil so that discharge generated in said discharge tube is maintained by said RF power, wherein said RF power generated by said RF source is supplied to said coil, said time-varying magnetic field is induced by said RF power supplied, and said electromagnetic power is supplied to said discharge tube via induced magnetic field, wherein said closed-loop tubular discharge tube comprises:

a first spiral tubular part twisted spirally;

a second spiral tubular part twisted with said first spiral tubular part to form a double-coil shape;

a curved tubular part connecting said first and second spiral tubular parts at corresponding ends; and a connecting part, which is at least partially surrounded by said core, connecting said first and second spiral tubular parts at the other corresponding ends in order to make said discharge tube form a closed-loop.

8. The electrode-less fluorescent lamp having a 3-D structure according to claim 7, wherein said discharge tube has a pressure equal to or greater than 0.5 Torr.

9. An electrode-less fluorescent lamp having a 3-D structure comprising:

a closed-loop tubular discharge tube enclosing a discharge gas, said tube being coated with a fluorescent layer on an inner surface and made of a light-transmissive material, wherein a center-line through said discharge tube forms a virtual closed-curved-surface of a 3-D structure in a 3-D space;

at least one core surrounding at least a portion of said discharge tube;

at least one coil wound around said at least one core, said coil supplying electromagnetic power to said discharge tube by producing a time-varying magnetic field in said core; and a radio frequency (RF) power source supplying RF power to said coil so that discharge generated in said discharge tube is maintained by said RF power, wherein said RF power generated by said RF source is supplied to said coil, said time-varying magnetic field is induced by said RF power supplied, and said electromagnetic power is supplied to said discharge tube via induced magnetic field, wherein said closed-loop tubular discharge tube comprises:

a first spiral tubular part twisted spirally;

a second spiral tubular part twisted with said first spiral tubular part to form a double-coil shape;

a first curved tubular part connecting said first and second spiral tubular parts at corresponding ends;

a third spiral tubular part twisted spirally;

a fourth spiral tubular part twisted with said third spiral tubular part to form a double-coil shape;

a second curved tubular part connecting said third and fourth spiral tubular parts at corresponding ends;

a first connecting part, which is at least partially surrounded by one of said at least one core, connecting said first and third spiral tubular parts at the other corresponding ends; and a second connecting part, which is at least partially surrounded by other one of said at least one core, connecting said second and fourth spiral tubular part at the other corresponding ends.

10. The electrode-less fluorescent lamp having a 3-D structure according to claim 9, wherein said discharge tube has a pressure equal to or greater than 0.5 Torr.

11. An electrode-less fluorescent lamp having a 3-D structure comprising:

a closed-loop tubular discharge tube enclosing a discharge gas, said tube being coated with a fluorescent layer on an inner surface and made of a light-transmissive material, wherein a center-line through said discharge tube forms a virtual closed-curved-surface of a 3-D structure in a 3-D space;

at least one core surrounding at least a portion of said discharge tube;

at least one coil wound around said at least one core, said coil supplying electromagnetic power to said discharge tube by producing a time-varying magnetic field in said core; and a radio frequency (RF) power source supplying RF power to said coil so that discharge generated in said discharge tube is maintained by said RF power, wherein said RF power generated by said RF source is supplied to said coil, said time-varying magnetic field is induced by said RF power supplied, and said electromagnetic power is supplied to said discharge tube via induced magnetic field, wherein said closed-loop tubular discharge tube comprises:

a first spiral tubular part twisted spirally;

a second spiral tubular part twisted with said first spiral tubular part to form a double-coil shape;

a first curved tubular part connecting said first and second spiral tubular parts at corresponding ends;

a third spiral tubular part twisted spirally;

a fourth spiral tubular part twisted with said third spiral tubular part to form a double-coil shape;

a second curved tubular part connecting said third and fourth spiral tubular parts at corresponding ends;

a fifth spiral tubular part twisted spirally;

a sixth spiral tubular part twisted with said fifth spiral tubular part to form double-coil shape;

a third curved tubular part connecting said fifth and sixth spiral tubular parts a corresponding ends;

a first connecting part, which is at least partially surrounded by one of said at least one core, connecting said first and third spiral tubular parts at the other corresponding ends;

a second connecting part, which is at least partially surrounded by other one of said at least one core, connecting said fourth and fifth spiral tubular parts at the other corresponding ends; and a third connecting part, which is at least partially surrounded by other one of said at least one core, connecting said second and sixth spiral tubular parts at the other corresponding ends.

12. The electrode-less fluorescent lamp having a 3-D structure according to claim 11, wherein said discharge tube has a pressure equal to or greater than 0.5 Torr.

* * * * *